United States Patent [19]

Kubota et al.

[11] 4,247,194

[45] Jan. 27, 1981

[54] CONTROL SYSTEM FOR ELECTROPHOTOGRAPHIC COPYING MACHINE

[75] Inventors: Yoichi Kubota, Tokyo; Masao Hosaka, Sagamihara; Kiyoshi Ohshima, Kawasaki, all of Japan

[73] Assignee: Ricoh Co., Ltd., Tokyo, Japan

[21] Appl. No.: 33,262

[22] Filed: Apr. 25, 1979

[30] Foreign Application Priority Data

May 8, 1978 [JP] Japan ..... 53-53798

[51] Int. Cl.[3] ..... G03G 15/00

[52] U.S. Cl. ..... 355/14 R

[58] Field of Search ..... 355/14 C, 14 R; 364/550, 551, 570, 580; 235/303, 304

[56] References Cited

U.S. PATENT DOCUMENTS 4,062,061 12/1977 Batchelor et al. ..... 355/14 C 4,122,996 10/1978 Wilczek ..... 355/14 C 4,156,133 5/1979 Legg ..... 355/14 C 4,162,396 7/1979 Howard et al. ..... 355/14 C

*Primary Examiner*—Richard L. Moses

*Attorney, Agent, or Firm*—Burgess, Ryan and Wayne

[57] ABSTRACT

A control system for electrophotographic copying machines which may forcibly return the component parts which are reciprocated and rotated during the copying operations to their home positions after a power switch is turned on, may detect malfunctions after the copying operations are started and may enable the copying machine to repeat the copying sequence without the feed of copying sheets for running tests in inspections and maintenance. One or more one-chip microcomputers are used in order to control the above and other steps so that a number of component parts may be minimized and the copying machines may be made compact in size and be economically fabricated.

3 Claims, 21 Drawing Figures

FIG. 5
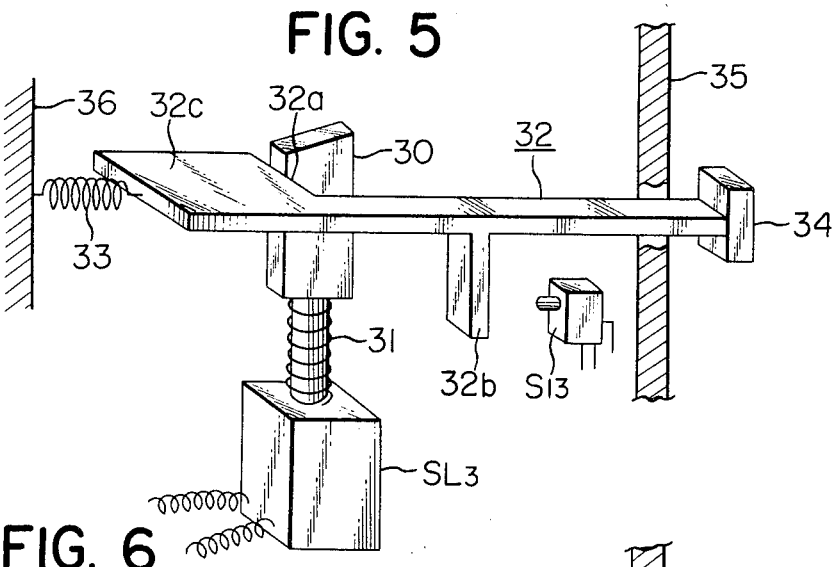
FIG. 6
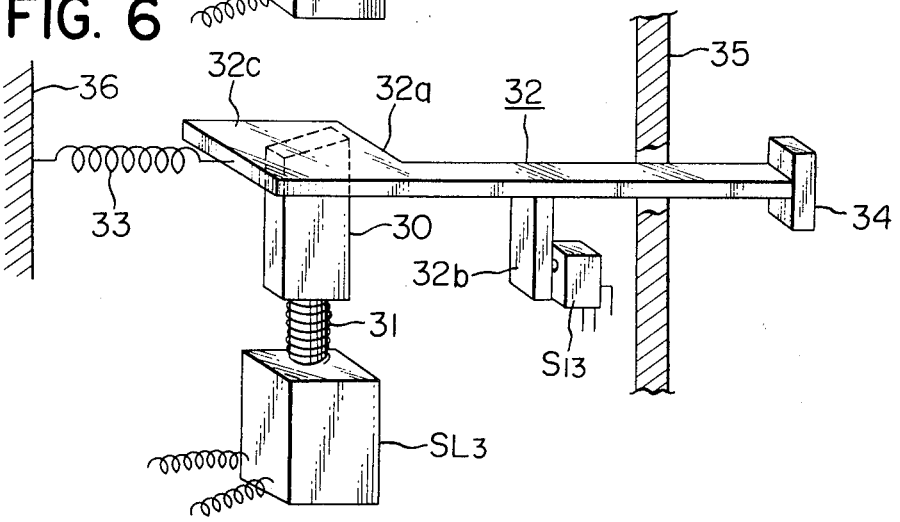
FIG. 10
| INPUT | | OUTPUT |
|---|---|---|
| A | B | Zn |
| 0 | 0 | 0 |
| 0 | 1 | Yn |
| 1 | 0 | Zn |
| 1 | 1 | Xn ⊙ Yn |

| | |
|---|---|
| FIG. 14A | FIG. 14C |
| FIG. 14B | FIG. 14D |

| FIG. 15C | |
|---|---|
| FIG. 15A | FIG. 15B |

| FIG. 17A |
| --- |
| FIG. 17B |

CONTROL SYSTEM FOR ELECTROPHOTOGRAPHIC COPYING MACHINE

BACKGROUND OF THE INVENTION

The present invention relates to a control system with a microcomputer for electrophotographic copying machines.

The prior art electrophotographic copying machines are provided with various sensor means and display means so as to sense and display a copy sheet cassette which is emptied, a toner supply means which is also emptied, jamming of copying sheets and so on. However so far there has not been available an electrophotographic copying machine which may detect the quality of reproduced copies and the tone of an original so as to automatically control the copying conditions. If a control system capable of such detections and subsequent automatic adjustments is provided with wired logic circuits and incorporated into a copying machine, the latter would be prohibitively complex in construction and large in size.

SUMMARY OF THE INVENTION

Accordingly, the present invention has for its object to provide a control system for electrophotographic copying machines which uses a microcomputer so that the copying sequence and peripheral conditions may be monitored; when component parts, which are reciprocated and rotated during the copying operations, may be forced to return to their home positions when a power switch is turned on; malfunctions during the copying operations may be detected and displayed; and the free run mode may be provided in which the copying sequence may be repeated without the feed of copying sheets for a number of times preset.

BRIEF DESCRIPTION OF THE DRAWINGS

FIGS. 5 and 6 are schematic perspective views showing the relationship between a jam keep solenoid and a jam keep switch;

FIG. 10 shows the truth table thereof;

DESCRIPTION OF THE PREFERRED EMBODIMENT

Figure 1:
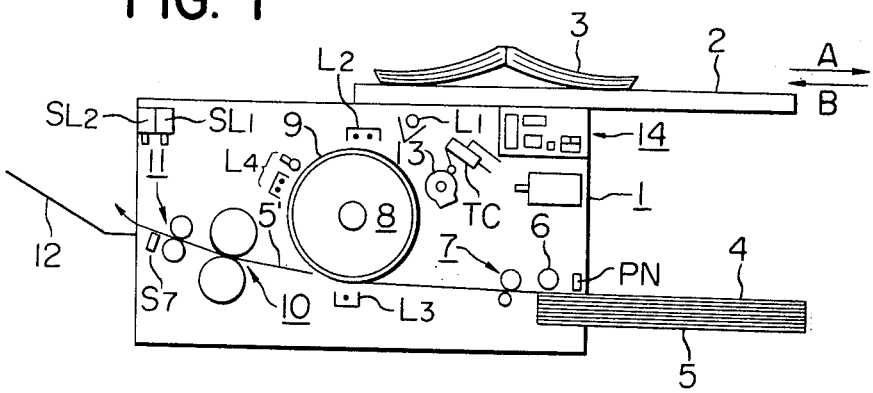
FIG. 1 is a schematic front view of a copying machine to which is applied the present invention.
Figure 2:
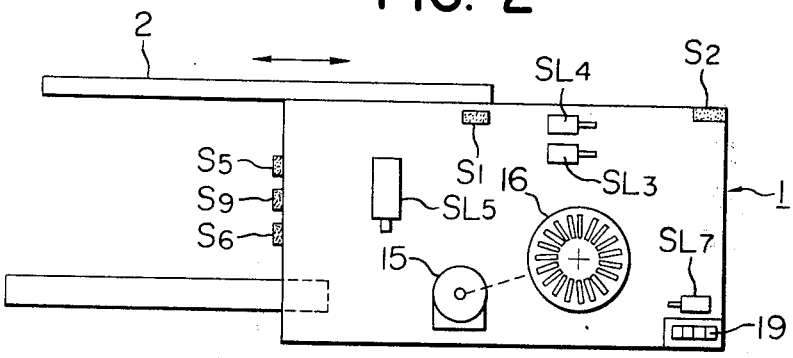
FIG. 2 is a schematic rear view thereof.

In FIGS. 1 and 2 are shown schematic interior views of a copying machine to which is applied the present invention. They show the arrangement of switches for generating input signals to a microcomputer so that the latter may control various processes as will be described in detail below, and various loads, solenoids and display devices which are all controlled in response to the output signals from the microcomputer.

In FIG. 1, reference numeral 1 denotes a main body of the copying machine; 2, an original stand; 3, an original to be copied; 4, a paper cassette containing copying sheets 5; PN, a copying sheet sensor switch with a photosensor which is turned on when the paper cassette 4 is emptied; that is, when there exists no copying sheet 5 in the cassette 4; 6, a feeding roller; 7, a pair of copying sheet transport rollers; 8, a photosensitive drum with a sheet-like photosensitive member 9 wrapped around the drum 8; 10, a pair of fixing rollers; 11, a pair of copying sheet discharge rollers; $S_7$, a discharge sensor switch which is turned on when a copying sheet 5' is being discharged; and 12, a copying sheet receiving tray.

13 is a timing cam with a projection for turning on a timing cam switch TC everytime when the drum 8 makes one rotation. The timing cam 13 is rotated in synchronism with the drum 8. $L_1$ is an exposure lamp such as a halogen lamp; $L_2$, a drum charger (a charging system load); $L_3$, a transfer charger (a transfer system load); $L_4$, a discharging charger and a discharging lamp (a discharge system load); $SL_1$, an original stand solenoid for causing the original stand 2 to move in the direction indicated by the arrow A; $SL_2$, an original stand solenoid for causing the original stand 2 to return in the direction indicated by the arrow B; and 14, an operation panel to be described in detail below.

Figure 3:
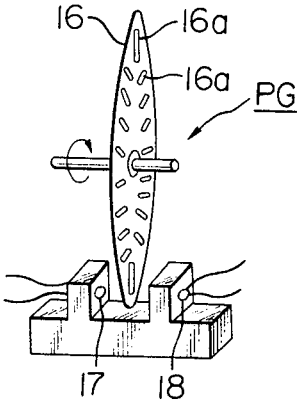
FIG. 3 is a perspective view of a timing pulse generator.

In FIG. 2, reference numeral 15 is a main motor for driving the drum 8 through a magnet contact (not shown); 16, a slit disk which is driven by the main motor 15 in synchronism with the drum 8 and is formed with a plurality of equiangularly spaced radial slits 16*a* (See also FIG. 3).

Referring to FIG. 3, a light source 17 such as a light emitting diode and a photosensor 18 such as a photodiode or the like are disposed on the opposite sides of the slit disk 16. They constitute a timing pulse generator PG which generates one timing pulse whenever a slit 16*a* permits the light ray emitted from the light source 17 to fall on the photosensor 18.

Referring back to FIG. 2, reference numeral 19 is a total counter for counting the total number of copying sheets; $SL_7$, a total counter solenoid for counting up this total counter; $S_1$, a switch for sensing a lifetime of the photosensitive member. In this embodiment, it is assumed that the lifetime of the photosensitive member 9 be such that it may reproduce 500 copies. Then a counter (not shown) is provided which may count up to 500 copies. Thus when the counter counts up to 500 copies, the sensor switch $S_1$ is turned on.

$SL_4$ is a counter reset solenoid for resetting the above 500 copies counter when it has counted 500 copy; $S_2$, an original stand home position solenoid which is turned on when the original stand 2 is in its home position; $SL_3$, a jam keep solenoid to be described in detail below; $SL_5$, a drum stop solenoid for stopping the drum 8 in the mode for removal of the photosensitive member 9 after the reproduction of 500 copies, this mode being referred to as "the photosensitive member removal mode" hereinafter in this specification; $S_5$, a photosensitive member removal mode switch which is normally kept turned on, but is turned off when an operator opens a door (not shown) of an opening through which the old photosensitive member is replaced with a new one; $S_9$, a photosensitive member replacement start switch which is turned on by the operator in the photosensitive member removal mode when a new photosensitive member is set; $S_6$, which must be turned on manually by the operator when he or she desires to use and feed copying sheets of a size different from the size of copying sheets 5 contained in the cassette 4, this manual copying sheet feeding operations being referred to as "the manual feed mode" in this specification hereinafter.

In addition to the above parts and even though not shown in FIGS. 1 and 2, the copying machine further includes an exposure lamp turn-off sensor switch LS for detecting whether the exposure lamp $L_1$ is turned off or not and a free-run-mode switch $S_{11}$ so located as to be operated by a worker in an inspection line in an assembly factory or by a service engineer for repairs and adjustments.

Figure 4:
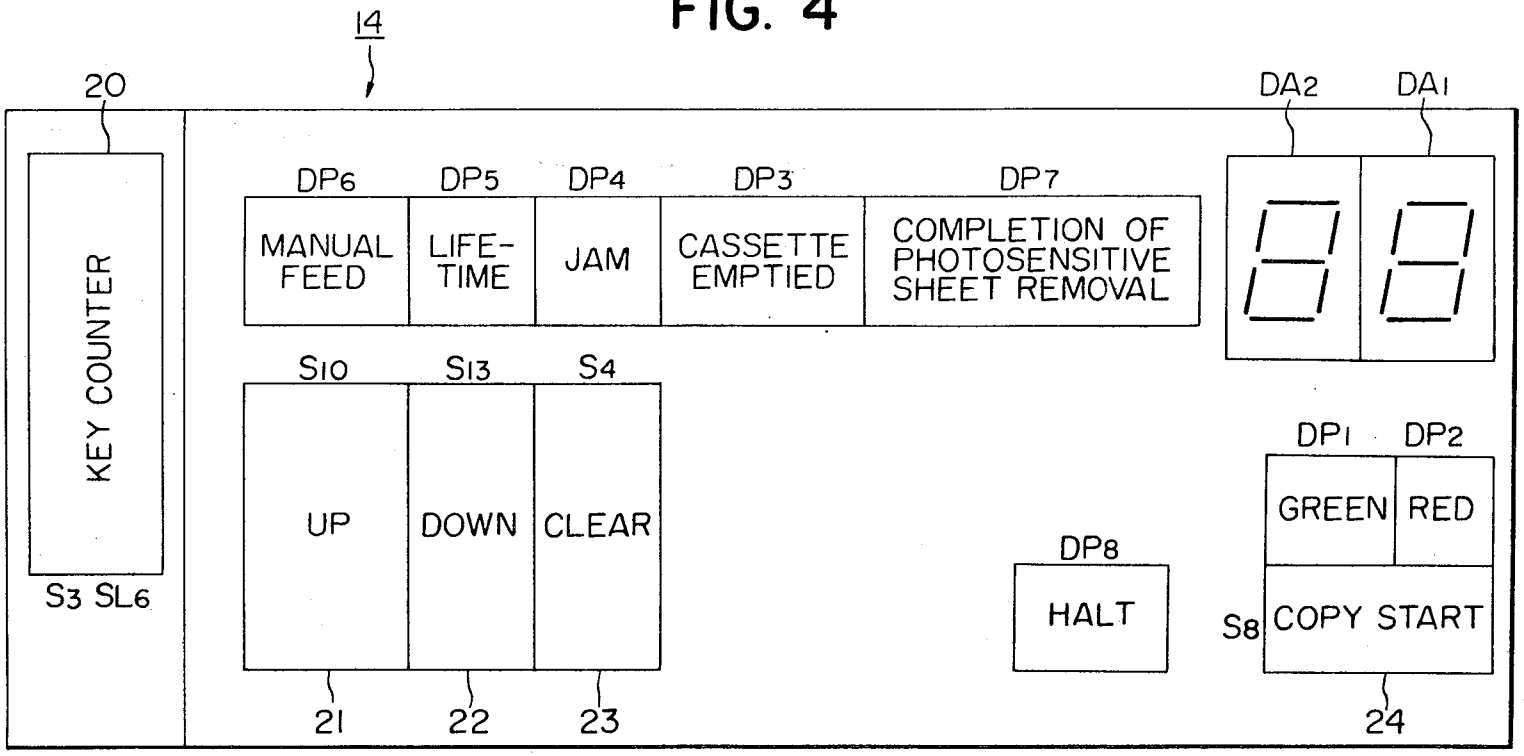
FIG. 4 is a top view of an operation panel or keyboard.

Next referring to FIG. 4, the keys and displays on the operation panel 14 will be described. Reference numeral 20 denotes a so-called key counter. When the operator mounts it on the operation panel, a key counter input switch $S_3$ on the side of the copying machine is turned on so that the copying machine may be operable. Only an authorized personnel may have one key counter 20 which inclues a counter capable of counting the copies. When the key counter 20 is mounted on the operation panel 14, the key counter solenoid $SL_6$ which causes the key counter 20 to count is driven into the energizable state.

21 and 22 are increment (UP) and decrement (DOWN) input keys which, upon depression, may increment or decrement a desired number of copies by turning on increment input switch $S_{10}$ and decrement input switch $S_{13}$, respectively. When a data clear switch 23 is depressed, a data clear switch $S_4$ is turned on so as to erase the existing data. When a copy start key 24 is depressed, a copy start switch $S_8$ is turned on so as to start the copying operations. When the copying operations may be started, a green lamp $DP_1$ is turned on. When a red lamp $DP_2$ is turned on even during the copying mode, it indicates that the copying mode cannot be started or the copying mode must be immediately suspended.

$DA_1$ and $DA_2$ are copy data displays each consisting of seven light-emitting diode segments. $DA_1$ displays a units digit and $DA_2$ display a tens digit. $DP_3$ is turned on when the cassette 4 is emptied. $DP_4$ is turned on when copying sheets 5 are jammed. $DP_5$ is turned on when the photosensitive member 9 reaches its predetermined lifetime; that is, 500 copies. $DP_6$ is turned on in the manual feed mode described above; $DP_7$ is turned on when the exhausted photosensitive member 9 is removed; that is, the end of the photosensitive member removal mode. $DP_8$ is turned on so as to indicate "HALT" of the microcomputer. That is, when a power switch is closed, the cam, the exposure lamp, a scanner of the original stand and other load systems which are not located at their normal positions are forced to return to their normal positions. $DP_8$ is turned on when some of them fail to return to their normal positions.

Next referring to FIGS. 5 and 6, the jam keep solenoid $SL_3$ will be described. When the solenoid $SL_3$ is not energized its plunger 30 is at an upper position as indicated in FIG. 5 and remains at this position under the biasing force of a spring 31. The plunger 30 is in engagement with a stepped portion 32*a* of an actuator 32 so that the latter is maintained at a left position against a bias spring 33. When the copy discharge sensor switch $S_1$ is not turned on in the copying mode, the microcomputer makes a decision that the copy sheet jamming has occurred and consequently causes the temporary energization of the jam keep solenoid $SL_3$. Then the plunger 30 is attracted downward against the force of the bias spring 31 and releases the actuator 32. Then under the force of the bias spring 33 the actuator 32 is caused to shift to the right as shown in FIG. 6 so that its projection 32*b* turns on the jam keep switch $S_{13}$ (which is disposed stationary). Then all driving systems are disabled and the jam keep solenoid SL is also deenergized. However the vertical upward shift of the plunger 30 is prevented by an enlarged portion 32*c* of the actuator 32 as shown in FIG. 6 so that the jam keep switch $S_{13}$ remains turned on. As a result, the jam lamp $DP_4$ and the red lamp $DP_2$ are kept turned on.

After a jammed copying sheet is removed, the reset button 34 at the left end of the actuator 32 is manually pushed to the left so that the actuator 32 may be returned to its normal position shown in FIG. 5. Then the jam keep switch $S_{13}$ is turned off.

In FIGS. 5 and 6, 35 denotes a panel of the main body of the copying machine and 36, a stationary member.

The parts of the input and output signal systems described above may be summarized as follows:

| | | |
|---|---|---|
| (1) | Input signal system: | |
| | copy number increment input switch | $S_{10}$ |
| | copy number decrement input switch | $S_{13}$ |
| | copy number clear switch | $S_4$ |
| | timing cam switch | TC |
| | pulse generator | PG |
| | copy start switch | $S_8$ |
| | key counter input switch | $S_3$ |
| | jam keep switch | $S_{12}$ |
| | photosensitive member replacement start switch | $S_9$ |
| | photosensitive member replacement mode switch | $S_5$ |
| | manual feed mode switch | $S_6$ |
| | cassette-empty sensor switch | PN |
| | copy discharge sensor switch | $S_7$ |
| | photosensitive member lifetime sensor switch | $S_1$ |
| | original stand home position sensor switch | $S_2$ |
| | exposure lamp turn-off sensor switch | LS |
| | free-running mode switch | $S_{11}$ |
| (2) | Output signal system: | |
| | magnet contactor | MC |
| | exposure lamp | $L_1$ |
| | charging system load | $L_2$ |
| | image transfer system load | $L_3$ |
| | discharge system load | $L_4$ |
| | copy mode display | $DP_1$ |
| | copy mode inhibit display | $DP_2$ |
| | cassette-empty display | $DP_3$ |
| | jam display | $DP_4$ |
| | photosensitive member lifetime display | $DP_5$ |
| | manual feed mode display | $DP_6$ |
| | photosensitive member removal complete display | $DP_7$ |
| | computer HALT display | $DP_8$ |
| | copy number display, units digit | $DA_1$ |
| | copy number display, tens digit | $DA_2$ |
| | original stand start solenoid | $SL_1$ |
| | original stand return solenoid | $SL_2$ |
| | jam keep solenoid | $SL_3$ |

-continued

| | |
|---|---|
| counter reset solenoid | $SL_4$ |
| drum stop solenoid | $SL_5$ |
| key counter solenoid | $SL_7$ |
| photosensitive member replacement solenoid | $SL_8$ |

Figure 7B:
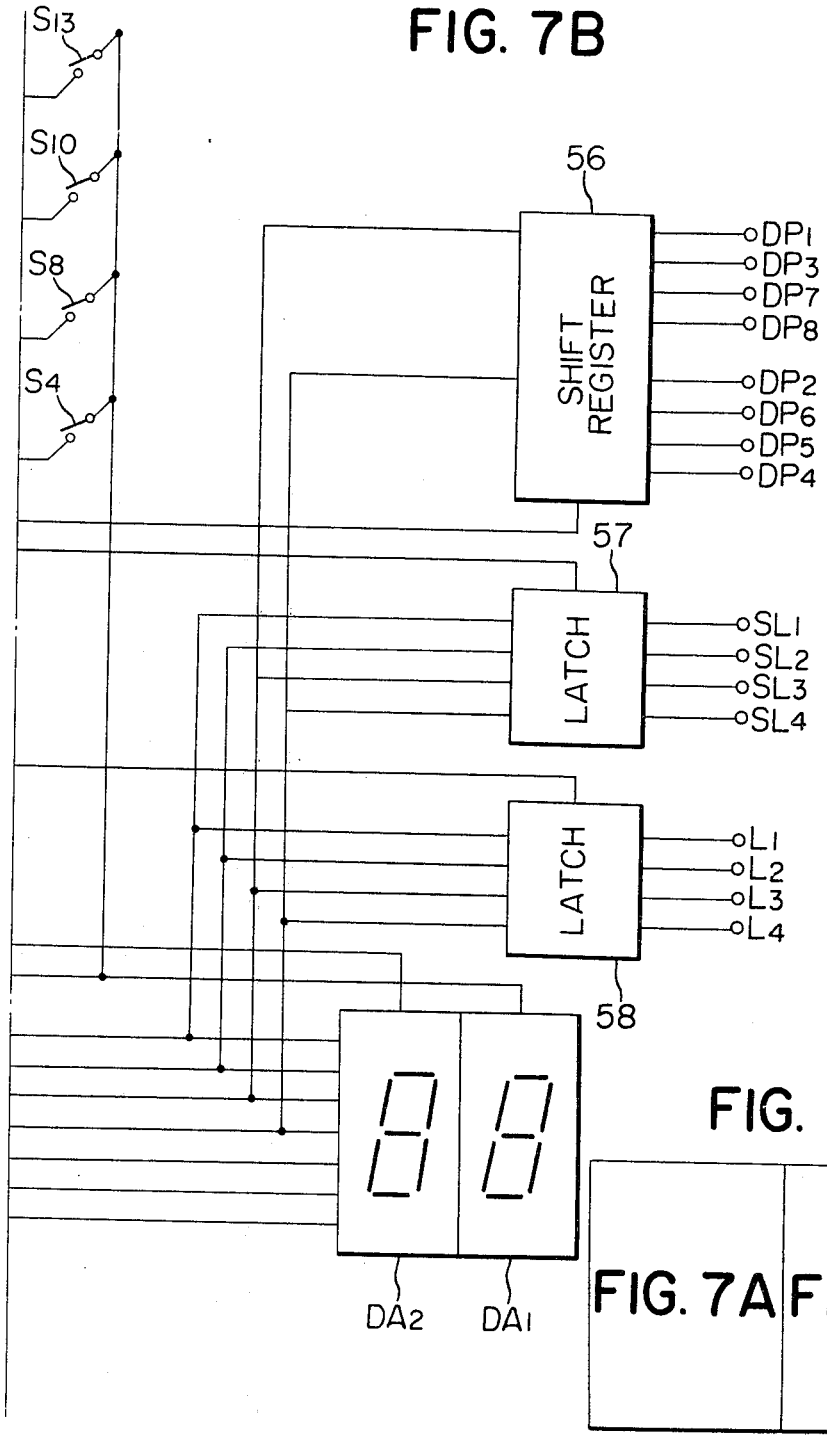
FIG. 7 is a block diagram of a preferred embodiment of a control system of the present invention.
Figure 7:
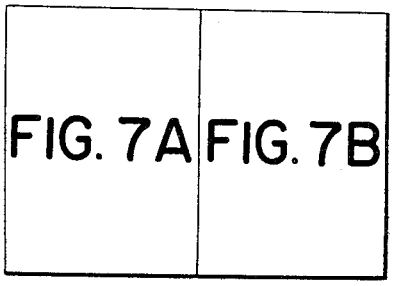
Figure 7A:
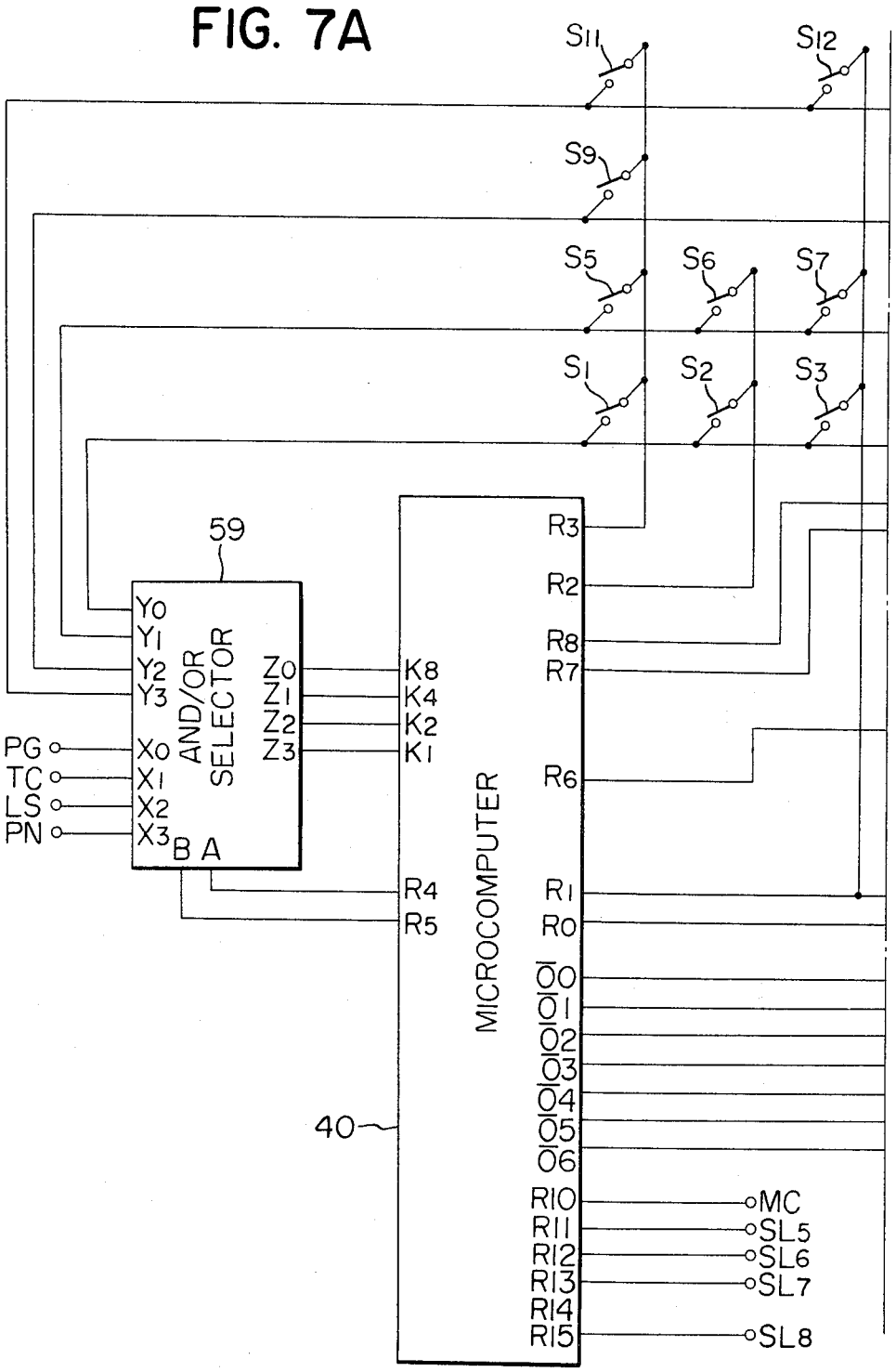
Figure 8:
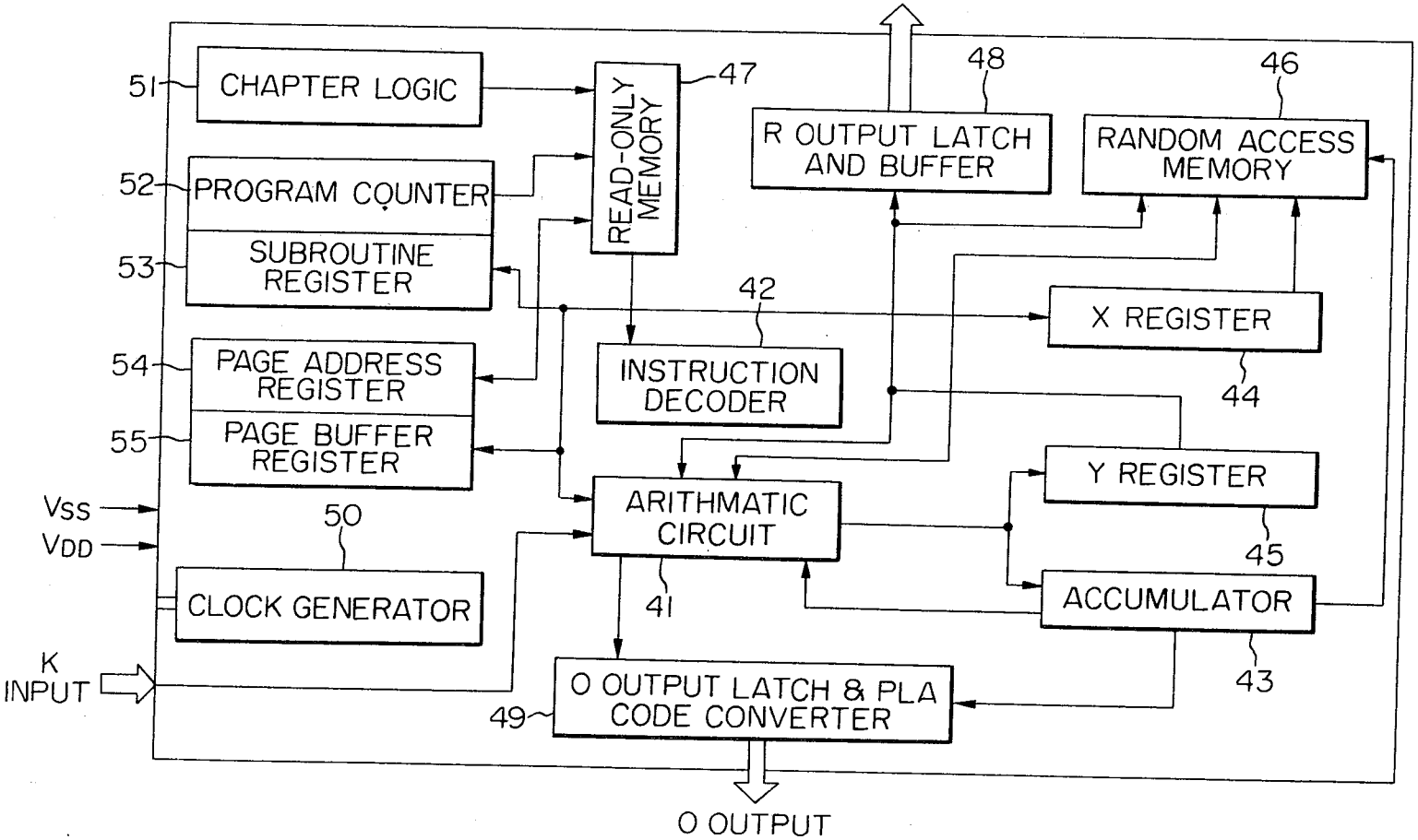
FIG. 8 is a block diagram of a microcomputer used in the preferred embodiment shown in FIG. 7.

In FIG. 7 is shown a block diagram of a control system wherein the symbols explained above are used. 40 is a one-chip microcomputer which is TMS 1300, the product of Texas Instrument Corp., in this embodiment. As shown in FIG. 7, the microcomputer 40 comprises an arithmetic circuit 41, an instruction decoder 42, an accumulator 43, an X register 44, a Y register 45, a random access memory 46, a read-only memory 47, an R output latch and buffer 48, an O output latch and PLA code converter 49, a clock generator 50, a chapter logic 51, a program counter 52, a subroutine return register 53, a page address 54 and a page buffer register 55.

As shown in FIG. 7, the microcomputer 40 has four K inputs $K_1$, $K_2$, $K_4$ and $K_8$. In response to the input (INP) from the instruction decoder 42, the data from K inputs are transmitted into the arithmetic circuit 41 so as to be tested whether each data is "1" or not. Alternatively, the data is stored in the accumulator 43. Data from K inputs may be periodically received by the microcomputer in synchronism with external equipment in response to R and gate signals to be described in detail below, and in response to one R output a plurality of 4-bit words may be controlled and stored.

The microcomputer 40 has two outputs; that is, R output and O output. R output consists of 16 latch data R0–R15. Each bit is addressed by the Y register 45 and the addressed bit may be set or reset. R output consists of inputs which are multiplexed. It may be also used so as to synchronize the O output which is the output data to the external equipment and the display output. The O output latch and PLA code converter 49 outputs O output as an eight-bit parallel output. In this embodiment, O0–O6 are display outputs applied to the copy number displays $DA_1$ and $DA_2$, and O0–O3 are outputs to the displays $DP_1$–$DP_8$, solenoids $SL_1$–$SL_4$ and the loads $L_1$–$L_4$.

In response to the output R8, shift register 56 delivers the output O2 to the displays $DP_1$, $DP_3$, $DP_7$ and $DP_8$ and the output O3 to the displays $DP_2$, $DP_6$, $DP_5$ and $DP_4$. A latch circuit 57 latches the O outputs O0–O3 and delivers them to the solenoids $SL_1$–$SL_4$ in response to and in synchronism with the R output R7. In like manner a latch circuit 58 latches the O outputs O0–O3 and delivers them to the loads $L_1$–$L_4$ in response to and in synchronism with the R output R6.

X input to an AND/OR selector 59 consists of $X_0$–$X_3$ which in turn are the outputs from the pulse generator PG, the timing cam switch TC, the exposure lamp turn-off sensor switch LS, and the cassette-empty sensor switch PN, respectively. Y input to the selector 59 consists of $Y_0$–$Y_3$ which in turn are the outputs from a switch matrix wherein the sensor switches $S_1$–$S_{13}$ are selectively closed in response to the R outputs R4 and R5 from the microcomputer 40, the selector 59 selects the X and Y inputs so as to deliver the Z outputs, $Z_0$–$Z_3$ to the microcomputer 40 as the K inputs.

Figure 9:
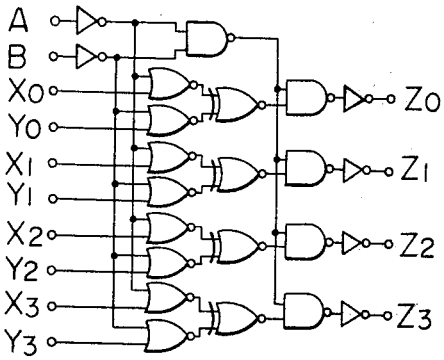
FIG. 9 shows logic circuits of an AND/OR selector.

In this embodiment, the selector 59 consists of MC14519B, the product of Motorola semiconductor products Inc. Its logic circuits are shown in FIG. 9 and the truth table is shown in FIG. 10. $Xn \oplus Yn$ is an exclusive NOR of Xn and Yn. (Only when either of Xn and Yn is "1" and the other is "0", Zn becomes "0".)

Figure 11:
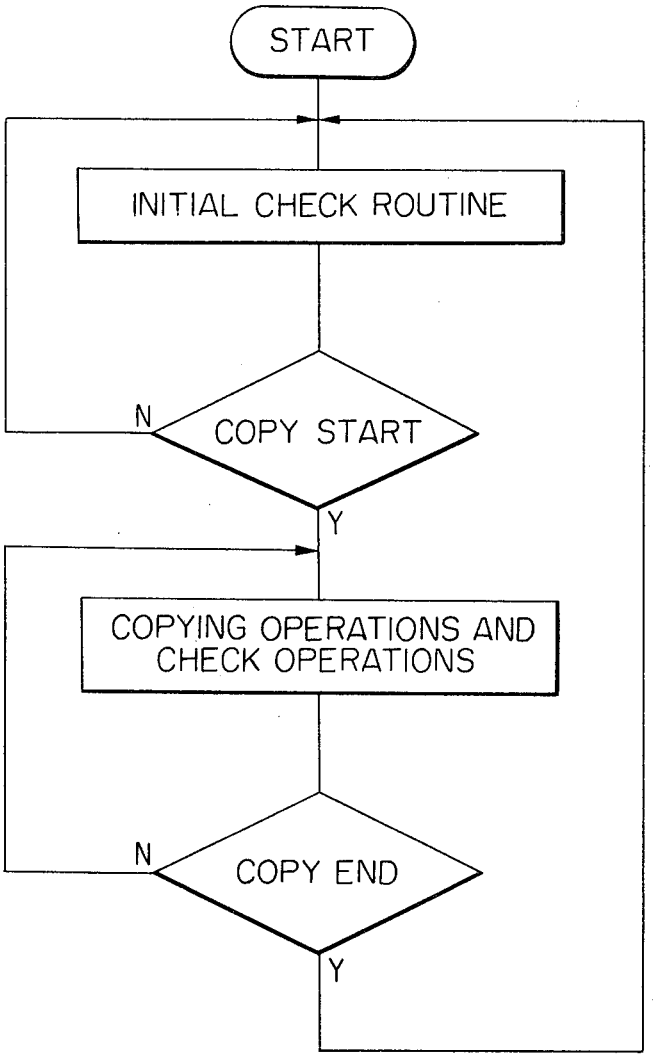
FIG. 11 shows a flow chart of the fundamental operations of the control system.

Next referring to FIG. 11 showing the flow chart of the fundamental operations of the control system of the present invention, the mode of operation will be described. When the power switch is turned on, the microcomputer (See FIG. 7) is enabled to initiate the initial check routine so as to check if all component parts are ready to operate prior to the start of the copy mode as will be described in detail below.

The object of the initial check routine is to check if all the component parts of the copying machine are in their home positions and if they are not all output systems are turned on so as to bring them back to their home positions, respectively, thereby avoiding the damages to the copying machine and the reproduction of unsatisfactory copies due to the abnormal operations of the component parts. However if all the component parts cannot be brought back to their home positions, all the control systems of the microcomputer 40 are disabled and the display $DP_8$ is turned on to warn the operator.

Then the operator must turn off the power switch and turns it on again to see if the display $DP_8$ is turned off.

After the initial check routine has been executed, whether or not the copy start switch $S_8$ is turned on is detected. When it is turned on, the copy routine is started, but when it is not turned on, the initial check routine is cycled.

In the copy routine, in response to the clock pulses from the pulse generator PG, a sequence of charging, exposure, developing, image transfer, fixing and other operations and checks (that is, the detections of the positions of the component parts and the detections of abnormal conditions) are time-serially effected. The copy sequence, the check sequence and the programs to be executed when abnormal conditions are detected are all stored in ROM. The check items will be described hereinafter.

After the completion of the copy mode, whether or not a desired number of copies are reproduced. If not, the copy routine is cycled. When a desired number of copies is obtained, the copying machine returns to the initial check routine and cycles it until the copy start switch $S_8$ is turned on again.

The initial check routine and the copy check routine are as follows:

[I] Contents of the initial check routine (1) Detection of the exposure lamp condition:

The microcomputer interprets that when the exposure lamp $L_1$ is turned on when it should be turned off, the microcomputer halts and causes the HALT display $DP_8$ to turn on.

(2) Detection of jam:

When the jam keep switch $S_{12}$ is turned on; that is, when it is not reset, the jam display $DP_4$ is turned on.

(3) Detection of the photosensitive member replacement mode:

Whether the photosensitive member replacement mode or the normal copy mode is detected and displayed accordingly.

(4) Detection of the position of the original stand:

In response to the signal from the sensor switch $S_2$, whether or not the original stand 2 is at its home position is detected.

(5) Detection of the position of the timing cam 15:

Whether or not the timing cam 15 is at its normal position is detected.

(6) Detection of copy discharge:

Whether or not a copy is still in the discharge passage is detected. (This step may be eliminated in the free-run mode.)

(7) Detection of the key counter mode:

In response to the key counter input switch $S_3$, whether or not the key counter is set is detected.

(8) Detection of the manual feed mode:

In response to the manual feed mode switch $S_6$, whether the manual feed mode or the automatic feed mode is detected.

(9) Detection of Cassette Empty:

In response to the output from the cassette empty sensor switch PN, whether or not the cassette is emptied is detected. (This step may be eliminated in the free-run mode.)

(10) Detection of a desired number of copies:

Whether or not a desired number of copies is keyed in is detected.

(11) Detection of copy start:

In response to the output from the copy start switch $S_8$, whether or not the copy start button is depressed is detected.

(12) Detection of free-run mode:

In response to the output from the free-run mode sensor switch $S_{11}$, whether or not the copying machine is in the free-run mode is detected.

[II] Contents of Copy Routine (1) Detection of the exposure lamp $L_1$:

The microcomputer interprets that when the exposure lamp $L_1$ is turned on when it should be turned off, the microcomputer halts and causes the HALT display $DP_8$ to turn on.

(2) Detection of jam:

When the jam keep switch $S_{12}$ is turned on; that is, when it is not reset, the jam display $DP_4$ is turned on.

(3) Detection of the photosensitive member replacement mode:

When the photosensitive member replacement mode is reached during the continuous copying operations, the copy number display is returned to "1", and the copy mode is suspended.

(4) Detection of the position of the original stand:

In response to a predetermined timing, whether or not the original stand 2 is returned to the home or start position is detected. If it is not returned, the computer 40 halts and the HALT display $DP_8$ is turned on.

(5) Detection of the timing cam:

Whether or not the timing cam is at the home or start position is detected. If it is not, the microcomputer 40 halts and the HALT display $DP_8$ is turned on.

(6) Detection of the key counter:

When the key counter is pulled out of the copying machine during the copying mode or cycle, the microcomputer 40 halts or the copying operations are inhibited depending upon a timing when the key counter is pulled out.

(7) Detection of the manual feed mode:

When the continuous copying mode is switched to the manual feed mode, the copying machine suspends the copy mode or cycle and then is ready for the manual feed mode.

(8) Cassette empty detection:

When the cassette is detected as being completely emptied during the continuous copying mode or cycle, the cassette empty display $DP_3$ is turned on and the further copying operations are inhibited.

(9) Detection of the entry of a desired number of copies:

Data of a desired number of copies are detected and supplied before the completion of one copying cycle.

(10) Detection of the copy start:

When the copy start switch $S_8$ is detected as being turned on immediately before the completion of one copying cycle, the same copying cycle is repeated.

(11) Detection of the free-run mode:

When the free-run mode is detected, no copying sheet is fed while a copying cycle is repeated. Therefore the results of the cassette empty detection and the copy discharge detection are ignored.

Next referring back to FIG. 4, the input of a desired number of copies and the display thereof will be described. When the power switch is turned on, the copy number display $DA_1$ and $DA_2$ displays [1]. When the operator depresses the increment or decrement key 21 or 22, the number being displayed is incremented or decremented by a number equal to a number of depressions of the increment or decrement key 21 or 22. A copy number data thus preset is stored in RAM in the microcomputer 40. The copy number displays $DA_1$ and $DA_2$ may display the copy number up to [99]. The copy number input device may be so designed and arranged that when the operator keeps the increment key 21 or the decrement key 22 depressed, the displayed number may be progressively incremented or decremented.

Of all the keys on the operation panel or the keyboard 14, the clear key 23 has the highest priority. Therefore when the clear key 23 is depressed, the copy number displays $DA_1$ and $DA_2$ are always reset to [1]. When only one copy is required, it will not be required to preset a copy number.

When the copy start key 24 is depressed, the display of a preset copy number vanishes and instead [0] is displayed. Thereafter every time when a counter in the microcomputer 40 counts one copy that is discharged out of the copying machine, the displayed number is incremented by one. That is, when the first copy is discharged, the display changes from [0] to [+1]. When the second copy is discharged, the display changes to [+2] and so on. The copying cycle is repeated until the number displayed by the displays $DA_1$ and $DA_2$ (to be referred to as the counter data) coincides with a present number of copies (to be referred to as the preset data). When the counter data coincides with the preset data, the counting is stopped and the preset data (equal to the counter data) is displayed. The copying machine is now in idling, and unless the print start button 24 is depressed for instance within one minute, the set data is automatically cleared and [1] is displayed again.

Next referring to FIG. 12, the free-run mode will be described. When the operator turns on the free-run mode switch $S_{11}$, the copying machine is brought into the free-run mode so that the copying machine may operate without the feed of copying sheets 5. The free-run mode is used for inspection, adjustments, repairs and maintenance in the production line and by service engineers. In the free-run mode, the detections of the discharges of the reproduced copies as well as the detection of the cassette emptied are ignored, and the free-run mode continues until the free-run mode switch $S_{11}$ is turned off. Even though the copying sheets are not fed in the free-run mode, a desired number of copies or preset data may be entered. Therefore after having cycled a preset number of copying operations, the copying machine idles as described above. When the start button $S_8$ is depressed again, the copying machine may repeat the copying cycles a number of preset times.

In FIGS. 13–18 is shown the whole flow chart of the control system of the present invention (the flow chart excludes the free-run mode). Throughout these figures the flow lines with the same symbols; that is, alphabets, are interconnected to each other. INP0–18 are input instructions the contents of which are described immediately below INP0–18. OUT0–22 are output instructions for executing the operations described immediately below them. The symbols such as S, TC and so on in the decision boxes correspond to the switches in the input system described elsewhere. Pulse is the one that is generated by the timing pulse generator PG. "Green lamp on" indicates that the copying operations may be permitted while "Red lamp on" indicates the inhibition of the copying operations.

Figure 19:
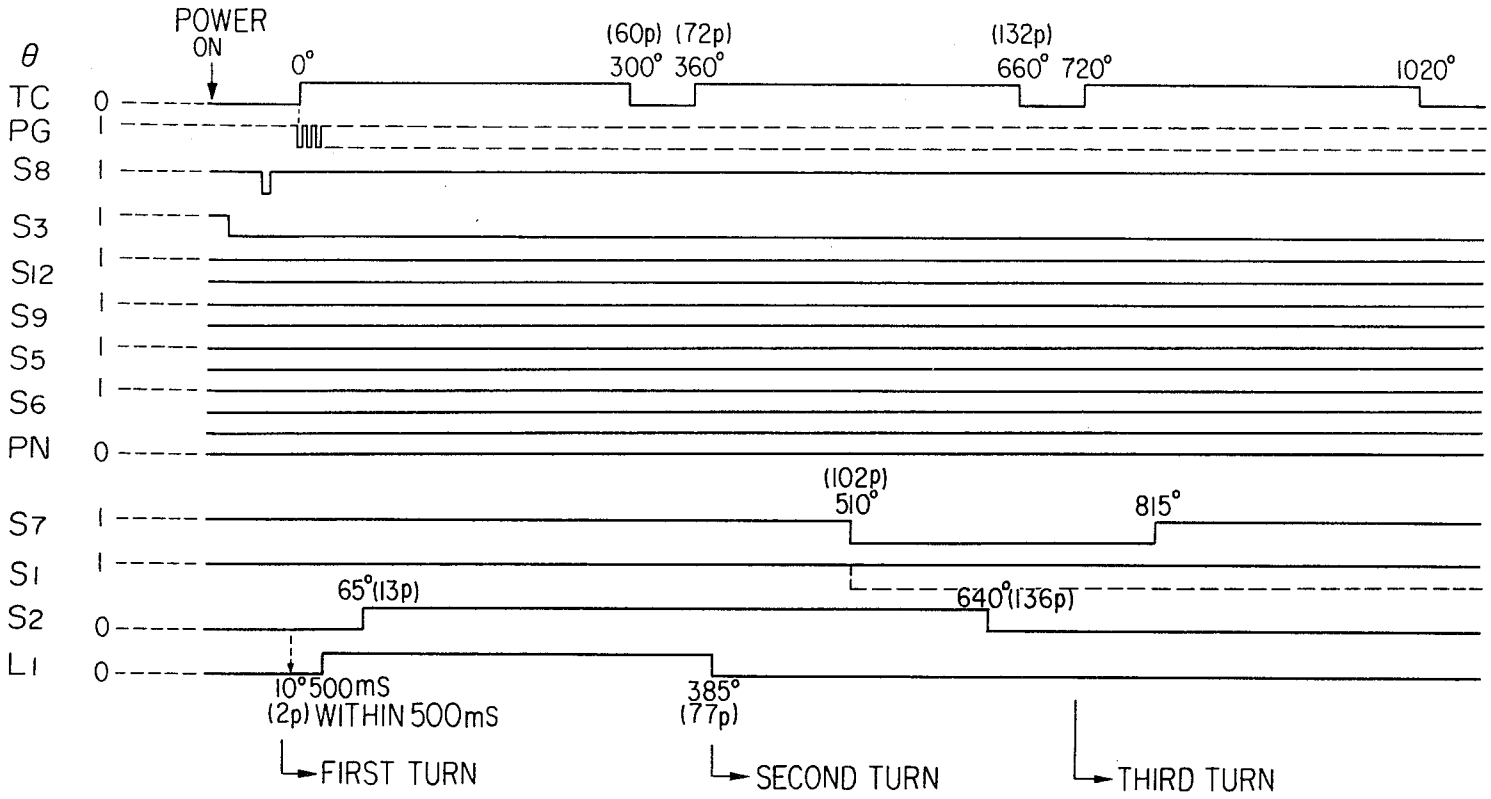
FIGS. 19, 20 and 21 show timing charts, respectively, of a single copy reproduction mode, a continuous copy reproduction mode and the photosensitive sheet or member replacement mode.
Figure 20:
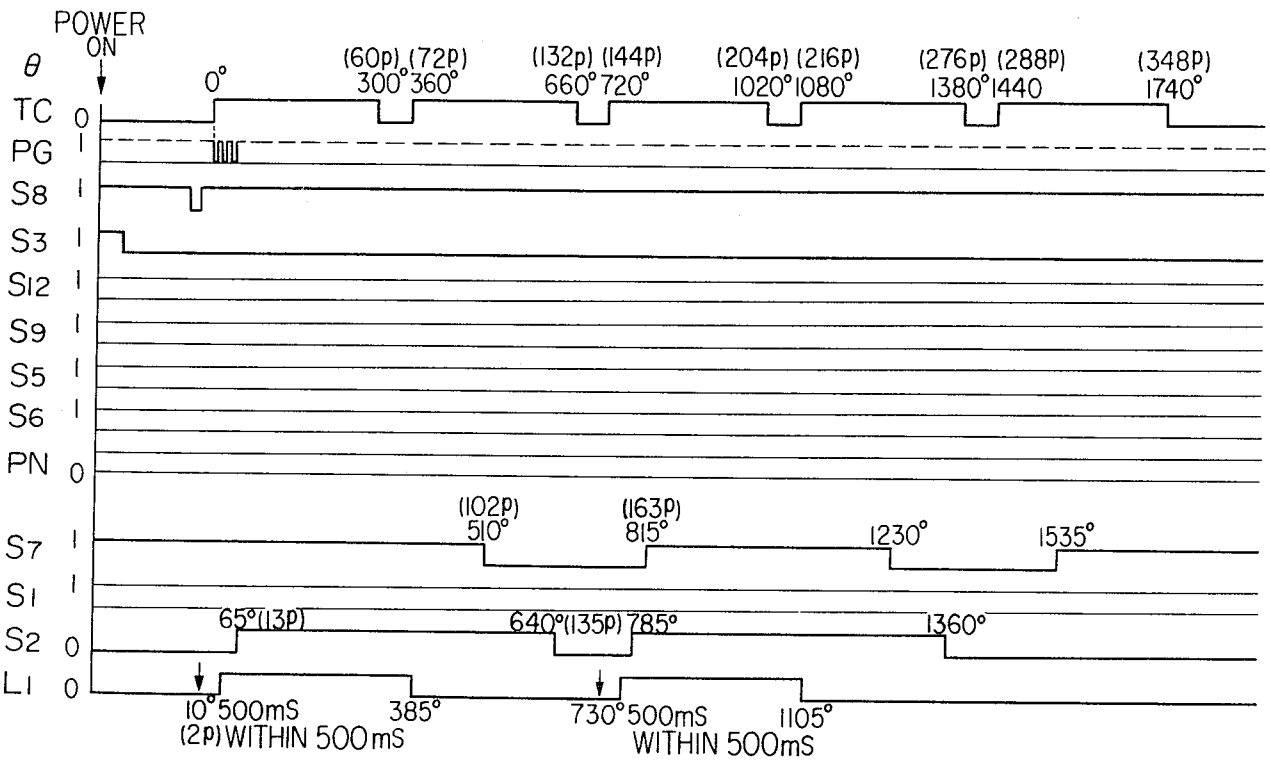
Figure 21:
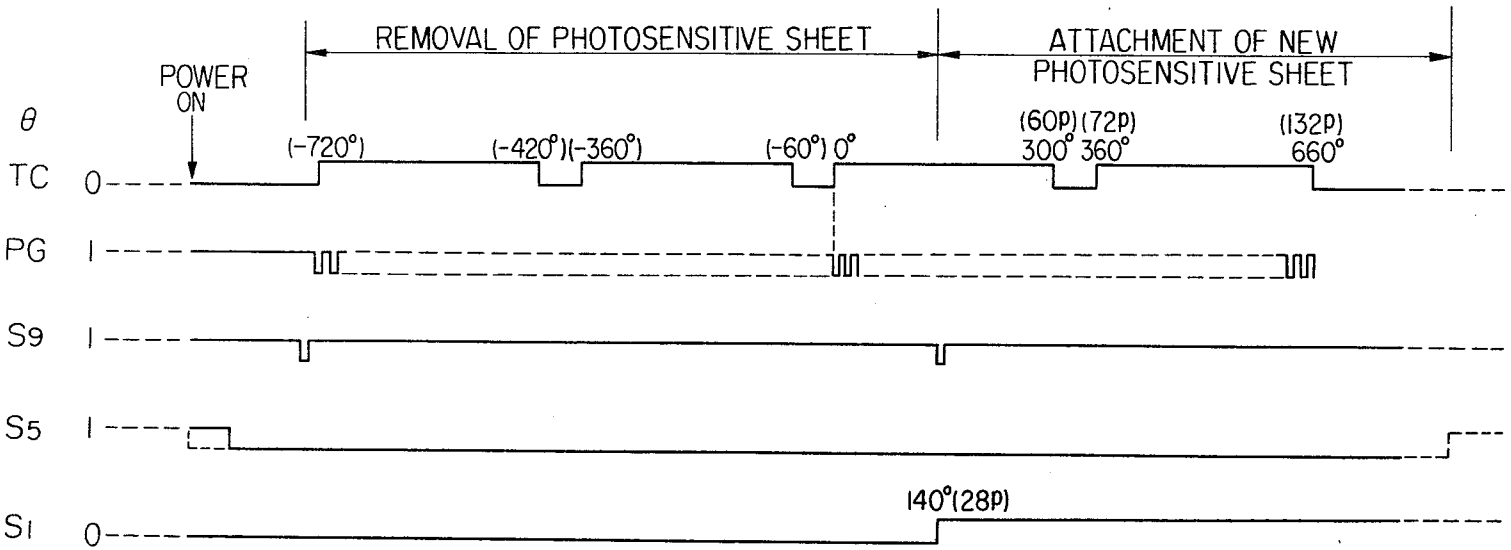

FIG. 19 shows the timing chart when only one copy is reproduced. FIG. 20 shows the timing chart when a plurality of copies are reproduced continuously. FIG. 21 shows the timing chart in the photosensitive member replacement mode. The symbol $\theta$ indicates the angle of rotation of the drum 8, and a number in the parentheses indicates a number of counted pulses from the pulse generator PG. The state "0" or "1" of each of the switches to be described below corresponds to "ON" or "OFF" in the flow chart.

| Symbols | Switches |
|---|---|
| TC | timing cam switch |
| $S_8$ | copy start switch |
| $S_3$ | key counter input switch |
| $S_{12}$ | jam keep switch |
| $S_9$ | photosensitive member replacement start switch |
| $S_5$ | photosensitive member replacement mode switch |
| $S_6$ | manual feed mode switch |
| $S_7$ | copy discharge sensor switch |
| $S_1$ | photosensitive member lifetime sensor switch |
| $S_2$ | home position switch |

FIGS. 13–21 are the summary of the description of one preferred embodiment of the control system of the present invention so that no further description shall be made except the description of the photosensitive member replacement mode which follows below.

Referring to FIG. 18, when the display lamp $DP_5$ is turned on, the operator interprets that the photosensitive member must be replaced with a new one. Therefore when the door of the opening for the replacement of the photosensitive member is opened, the photosensitive member replacement mode switch $S_5$ is turned on (See FIG. 13) so that the green lamp is turned off while the red lamp is turned on. Furthermore the magnet contact MC is turned off so that the drum 8 rests standstill. When the photosensitive member replacement start switch $S_9$ is turned on, the photosensitive member removal mode is started. That is, the magnet contactor MC is turned on so that the drum 8 is rotated. When the timing cam switch TC is turned off, the photosensitive member replacement solenoid $SL_8$ is energized so that the removal of the photosensitive member or sheet is started. When the drum 8 makes two turns plus 135°, the drum stop solenoid $SL_5$ is energized so as to stop the drum 8. 0.2 seconds after the drum 8 is stopped, the magnet contactor MC is turned off, and three seconds after the drum stop solenoid $SL_5$ is also de-energized and the removal complete display $DP_7$ is turned on, indicating the completion of the photosensitive sheet removal mode.

The new photosensitive member attachment mode is started by setting a new photosensitive sheet and turning on the replacement start switch $S_9$. Then the removal complete display $DP_7$ is turned off and the magnet contactor MC is turned on. The counter reset solenoid $SL_4$ is also energized so as to reset the modulo-500 counter. Then the photosensitive member lifetime sensor switch $S_1$ is turned off. When the drum is rotated through 115°, the photosensitive member replacement solenoid $SL_8$ is de-energized. When the timing cam switch TC is turned on for the second time, the magnetic contactor MC is turned off. When the operator closes the door of the replacement opening, the photosensitive member replacement mode switch $S_5$ is turned on, indicating the completion of the photosensitive member replacement mode.

So far the microcomputer 40 has been described as being of one chip type, but it is to be understood that an evaluation microcomputer with an external ROM which is called an evaluation chip may be used. When the so-called EP ROM in which writing and erasure are easy is used, design modifications may be much facilitated. In the case of the production in small quantity, the cost will be lower than when one-chip microcomputers are used.

What is claimed is:

1. An electrophotographic copying machine comprising a control system, position sensor means for detecting the positions of component parts after a power switch is turned on, forced-return means for forcibly returning the component parts to their predetermined positions when they are detected as being out of said their predetermined positions, means for displaying the failure of any of the component parts returning to said their predetermined positions, means for detecting the positions of the component parts at any time after the copying operations are started, and means for displaying the deviations of the component parts from their predetermined positions and inhibiting the copying operations when a deviation is detected.

2. An electrophotographic copying machine as set forth in claim 1 wherein free-run means is provided which enables said copying machine to carry out the copying sequence of charging, exposure, developing, imag transfer and fixing without feeding copying sheets for diagnostication.

3. An electrophotographic copying machine as set forth in claim 1 wherein the operation timing after the copying operations are started is determined in response to the timing of the output pulses from a pulse generator.

* * * * *

UNITED STATES PATENT AND TRADEMARK OFFICE

CERTIFICATE OF CORRECTION

PATENT NO. : 4,247,194

DATED : Jan. 27, 1981

INVENTOR(S) : Yoichi Kubota, et al

Figure 12:
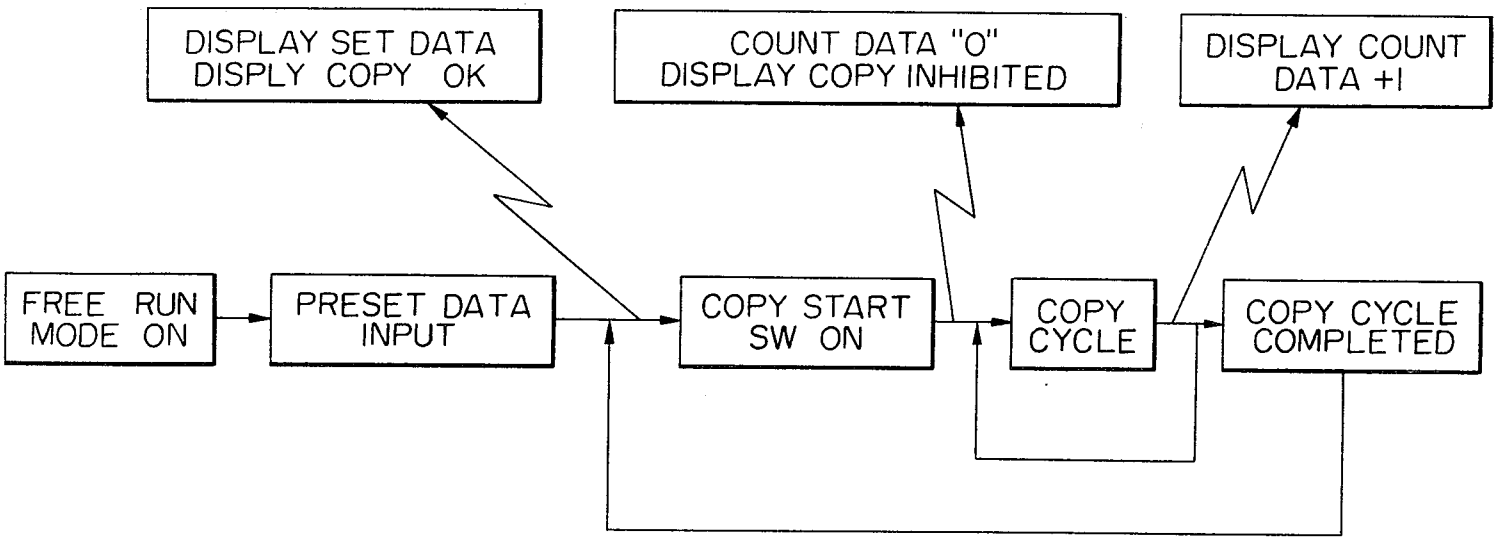
FIG. 12 is a flow chart of the free run mode.

It is certified that error appears in the above—identified patent and that said Letters Patent is hereby corrected as shown below:

FIG. 12 of the drawings: "DISPLY COPY OK" should read --DISPLAY COPY OK--.

Figures 13, 13A, 13B:
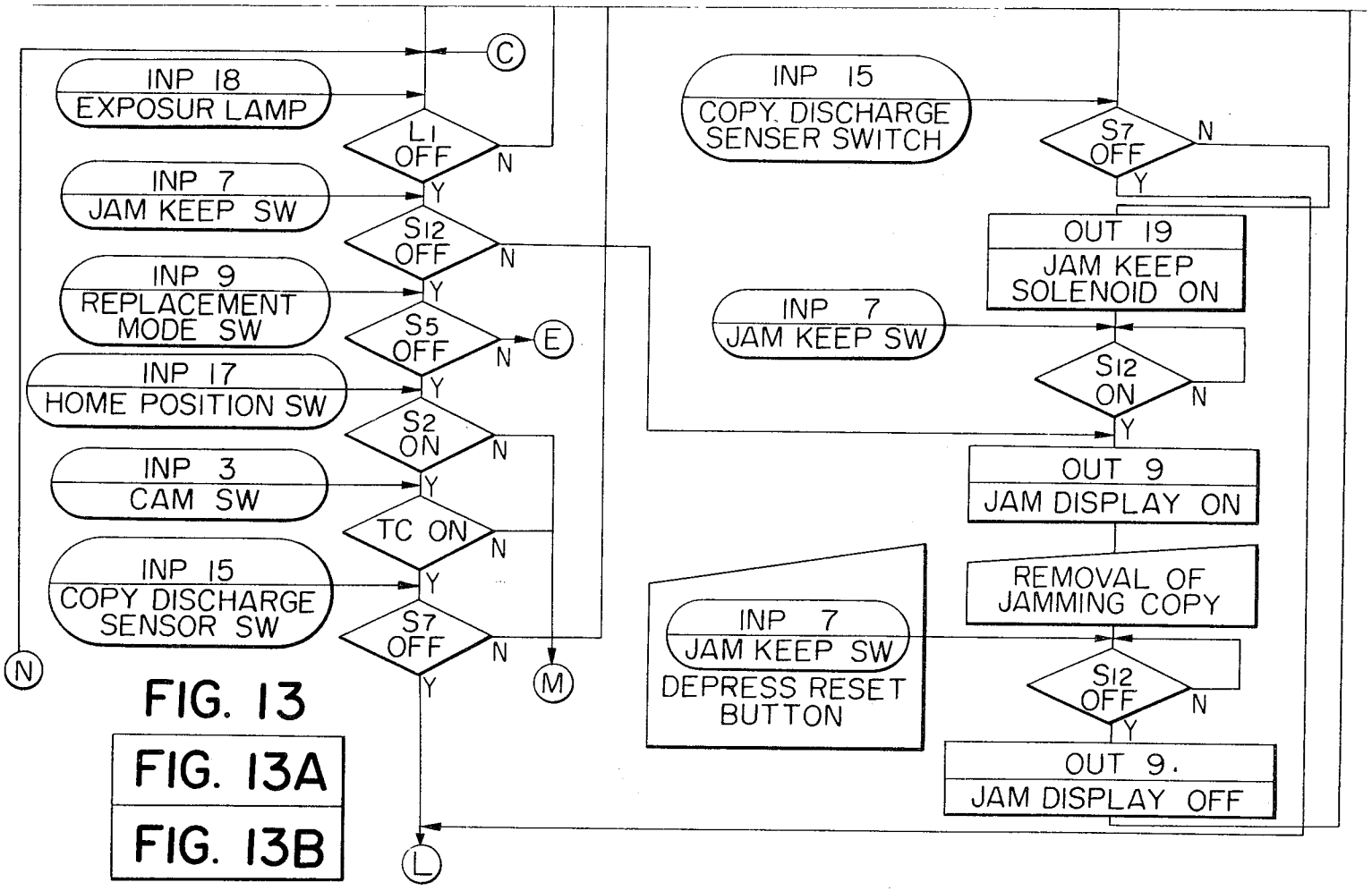
FIGS. 13–18 show a detailed flow chart illustrating the operations of the control system except the free-run mode.
Figure 13A:
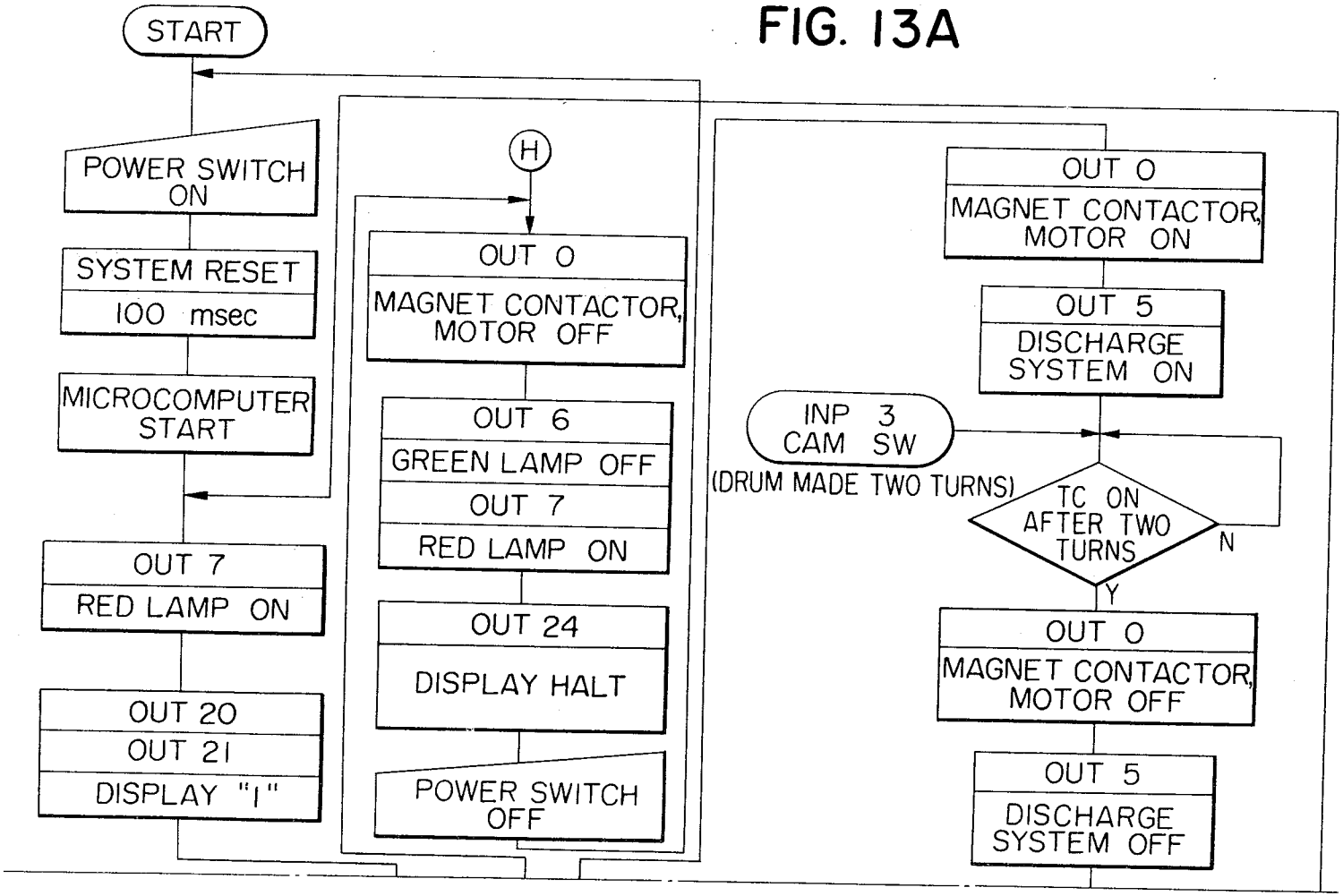
Figures 14, 14D:
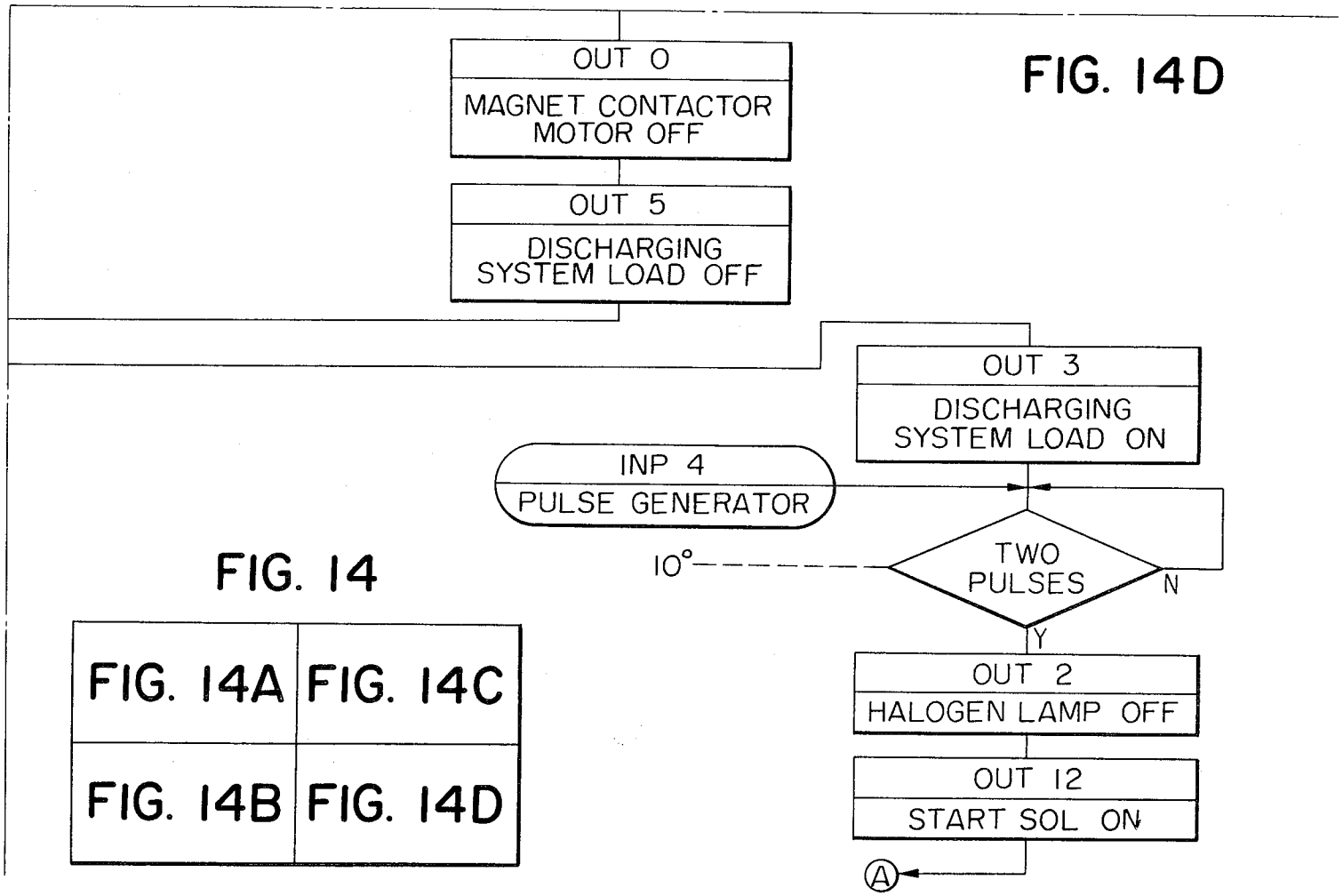
Figure 14A:
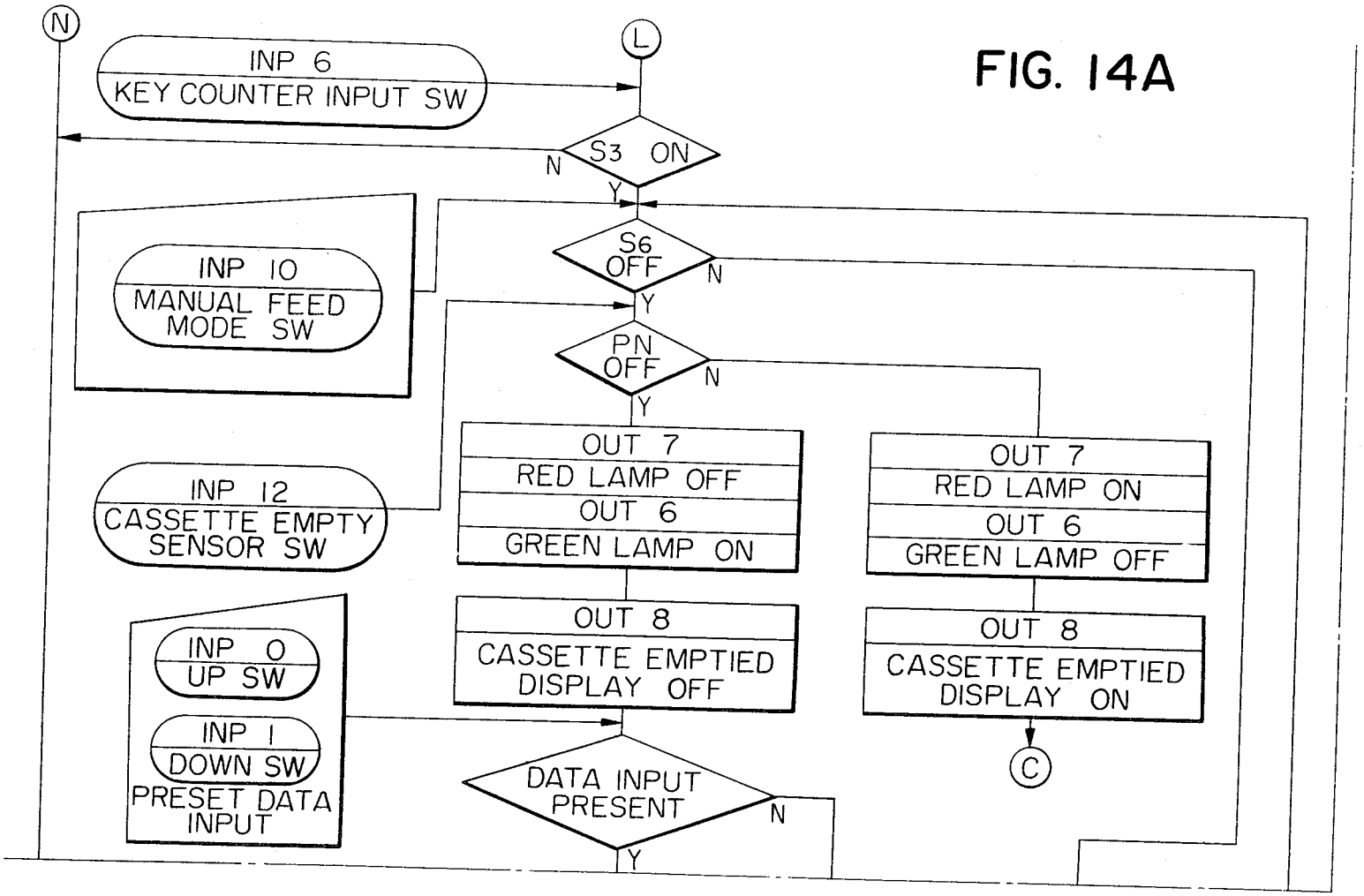
Figure 14B:
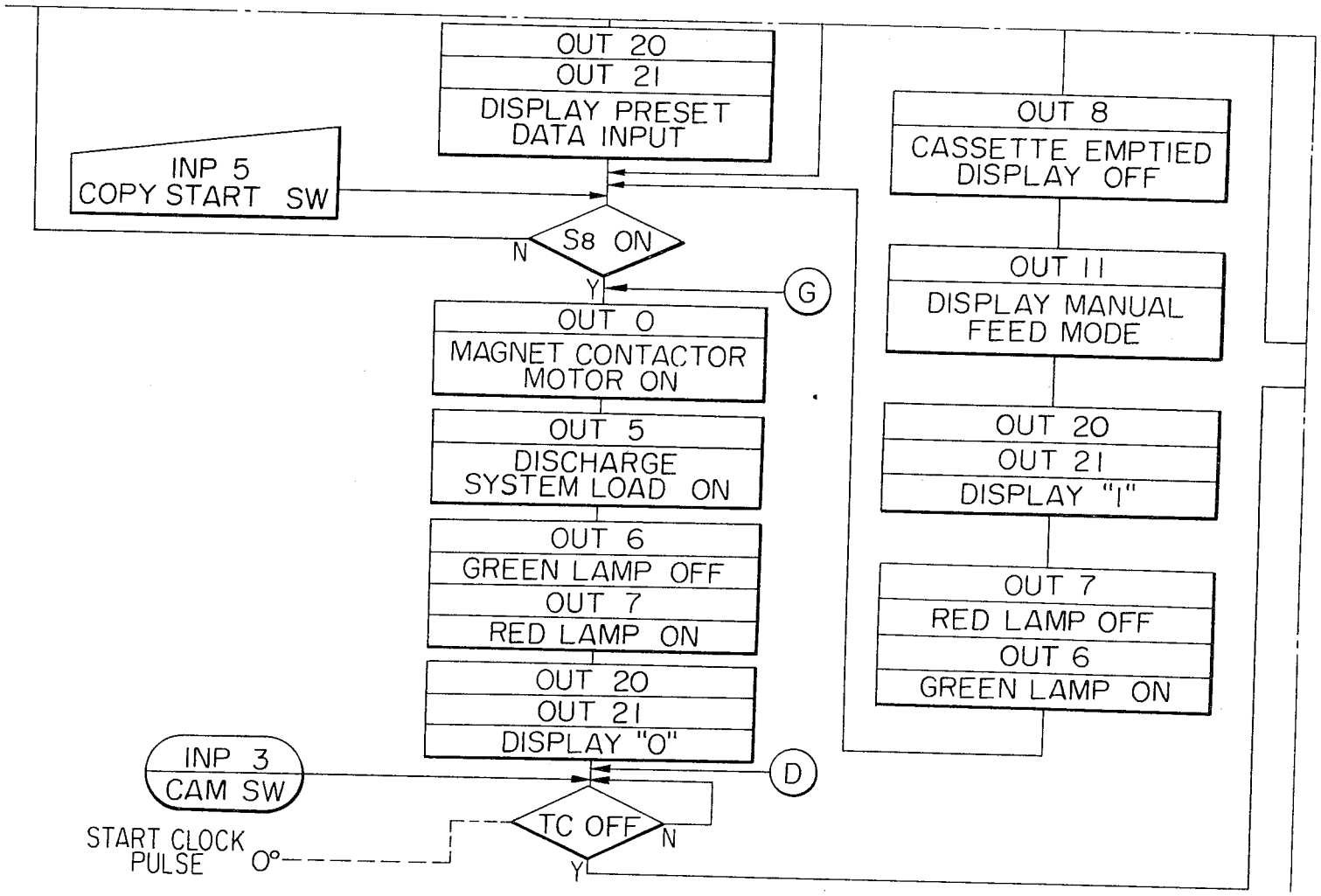
Figure 14C:
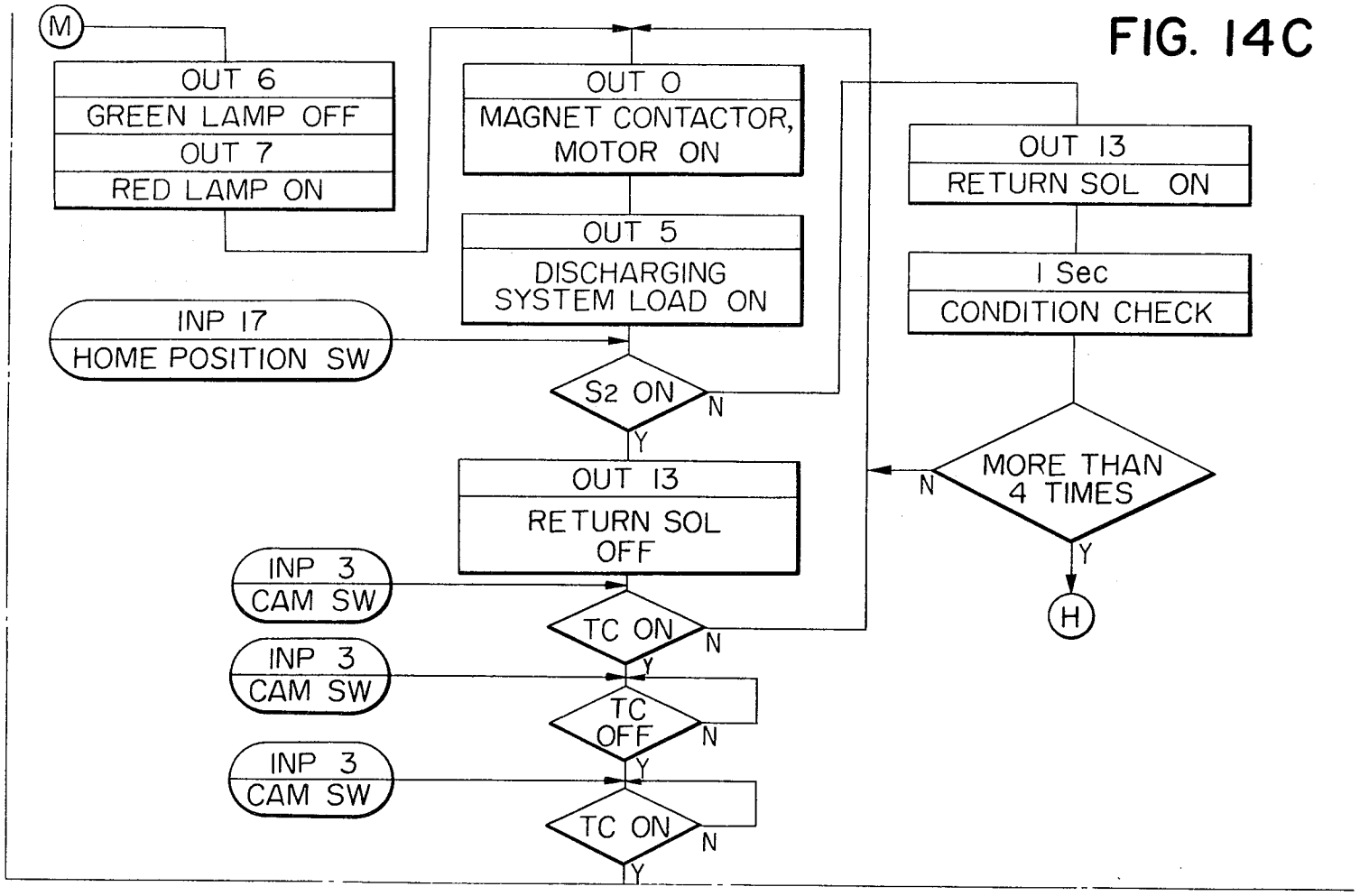
Figures 15, 15B:
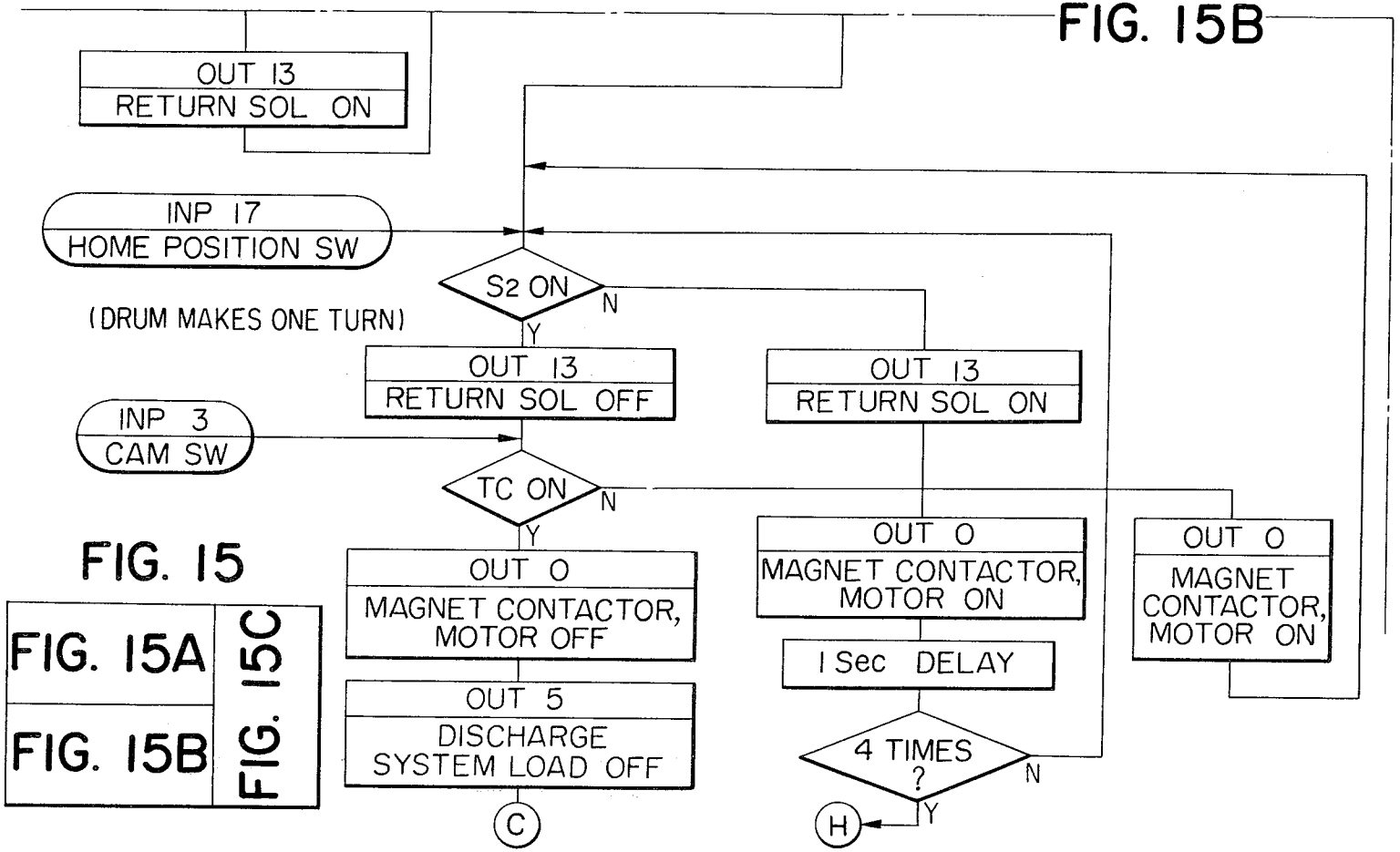
Figure 15A:
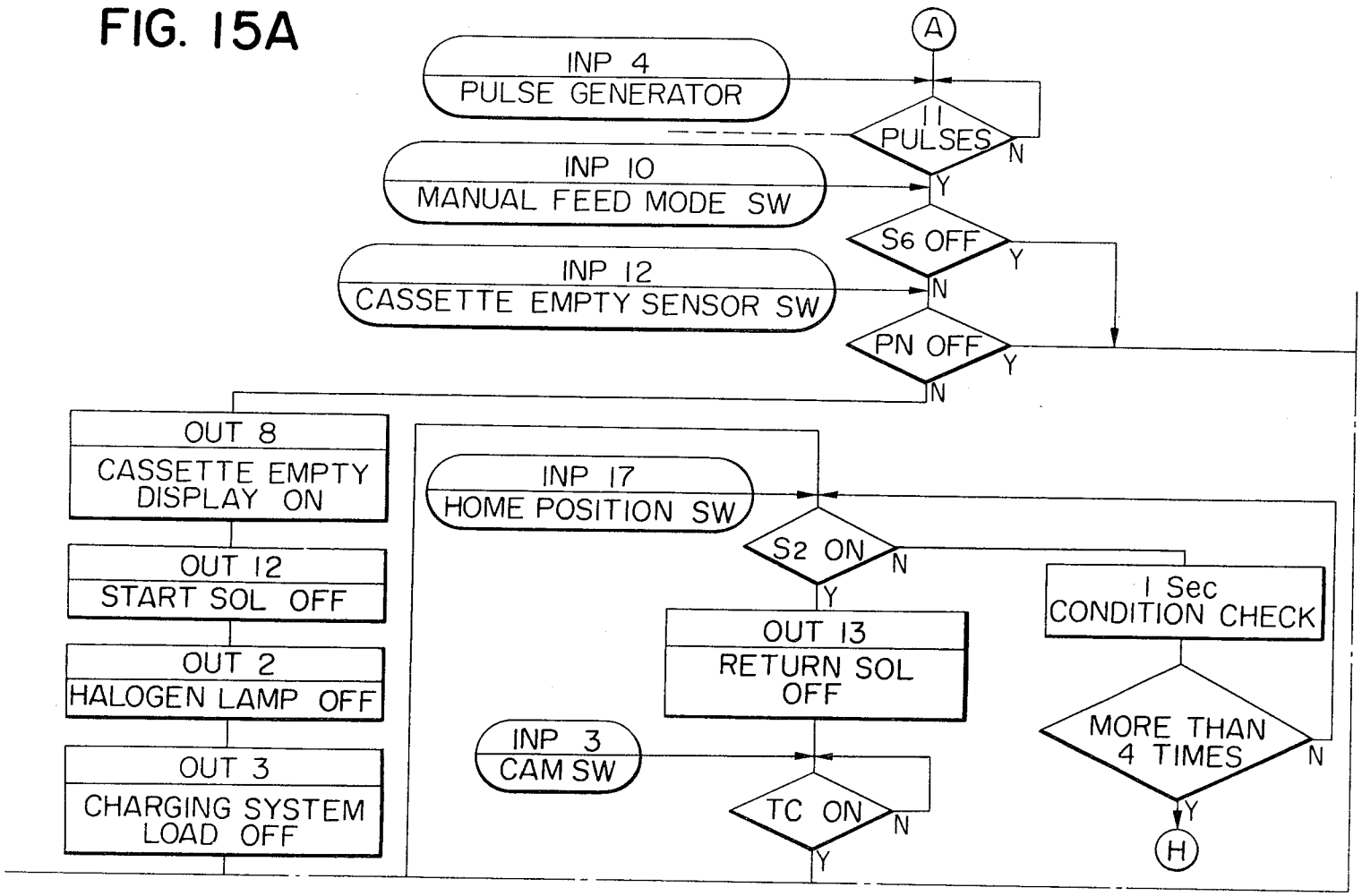
Figure 15C:
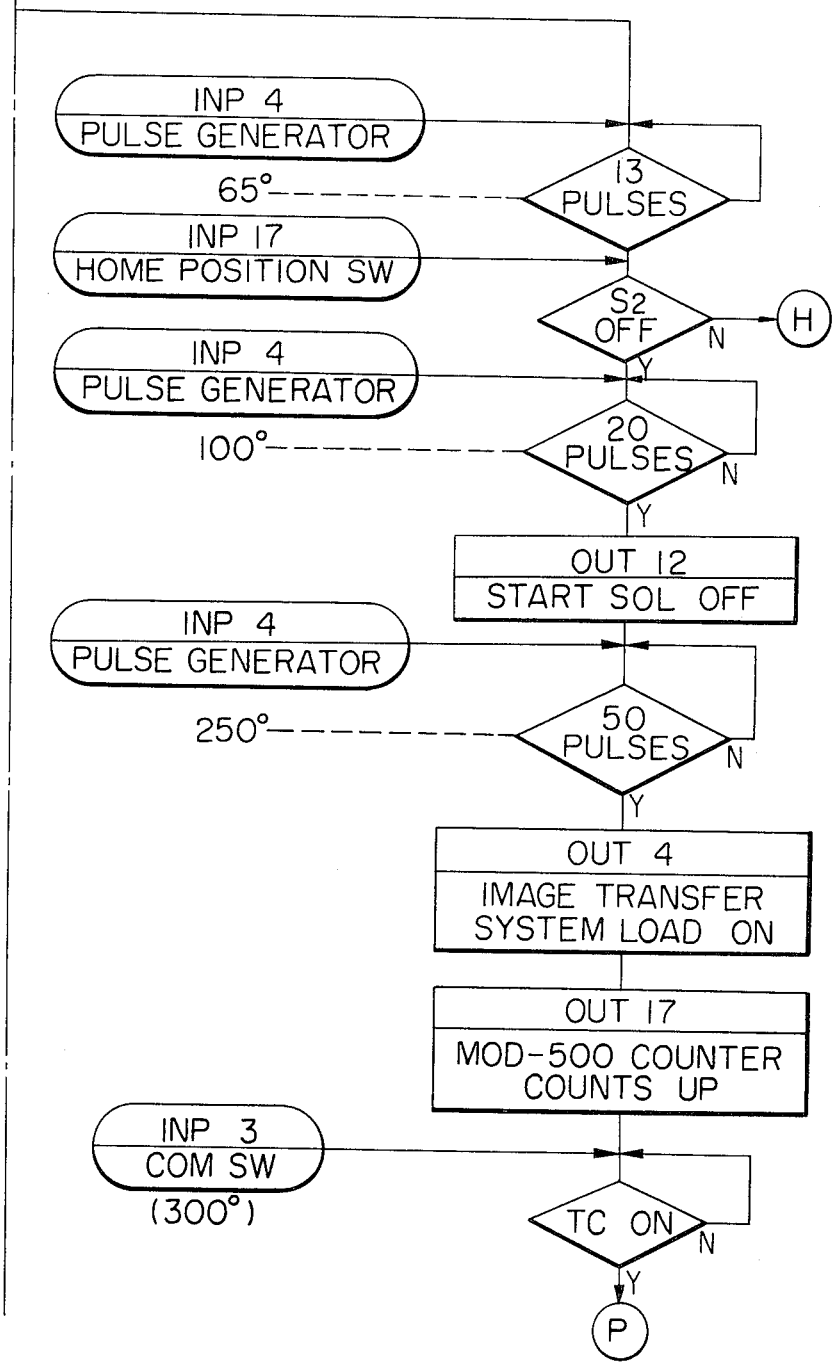

FIG. 13 of the drawings, in the upper left hand corner: "EXPOSUR LAMP" should read --EXPOSURE LAMP--.

Figures 16, 16C:
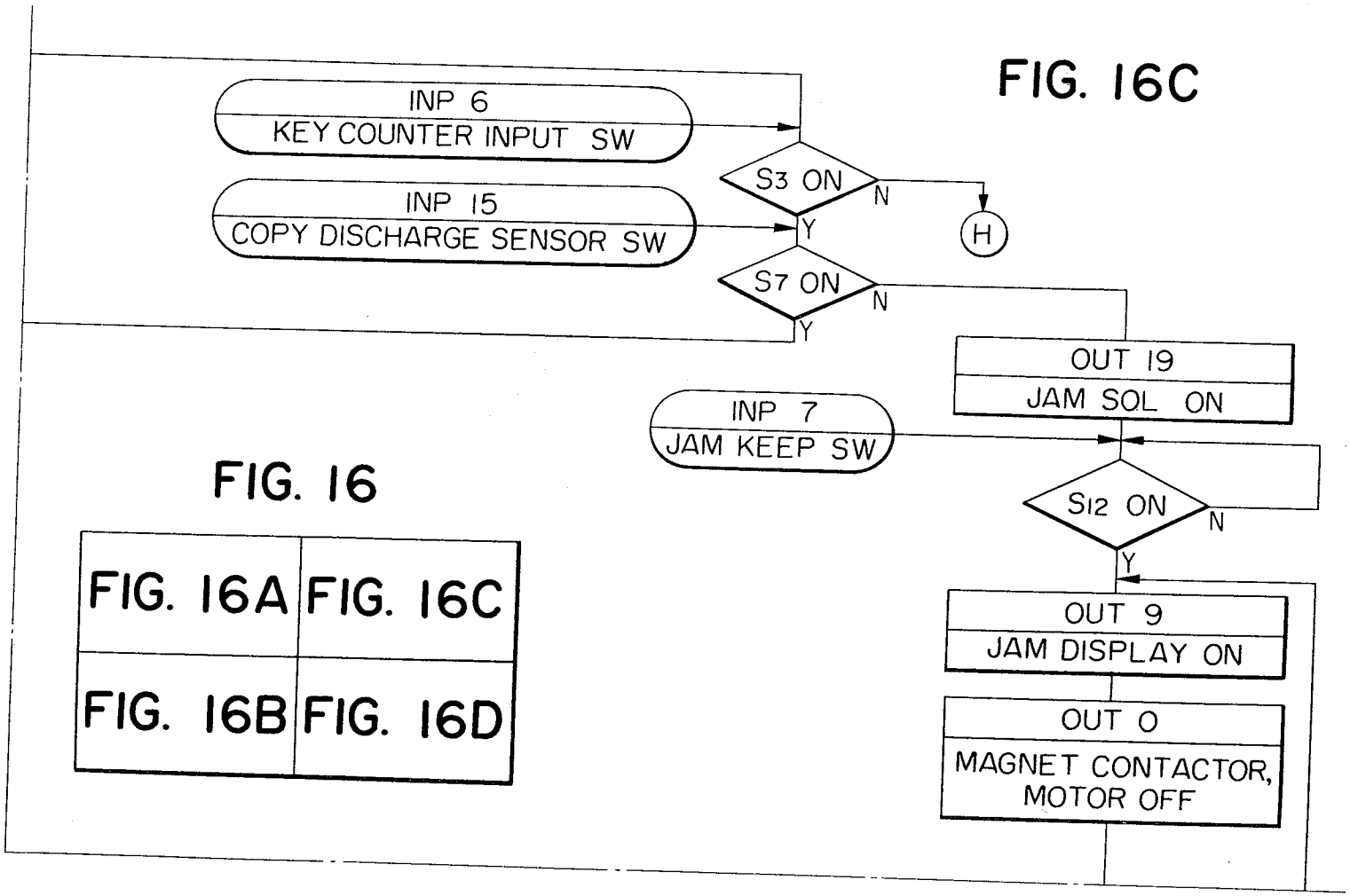
Figure 16A:
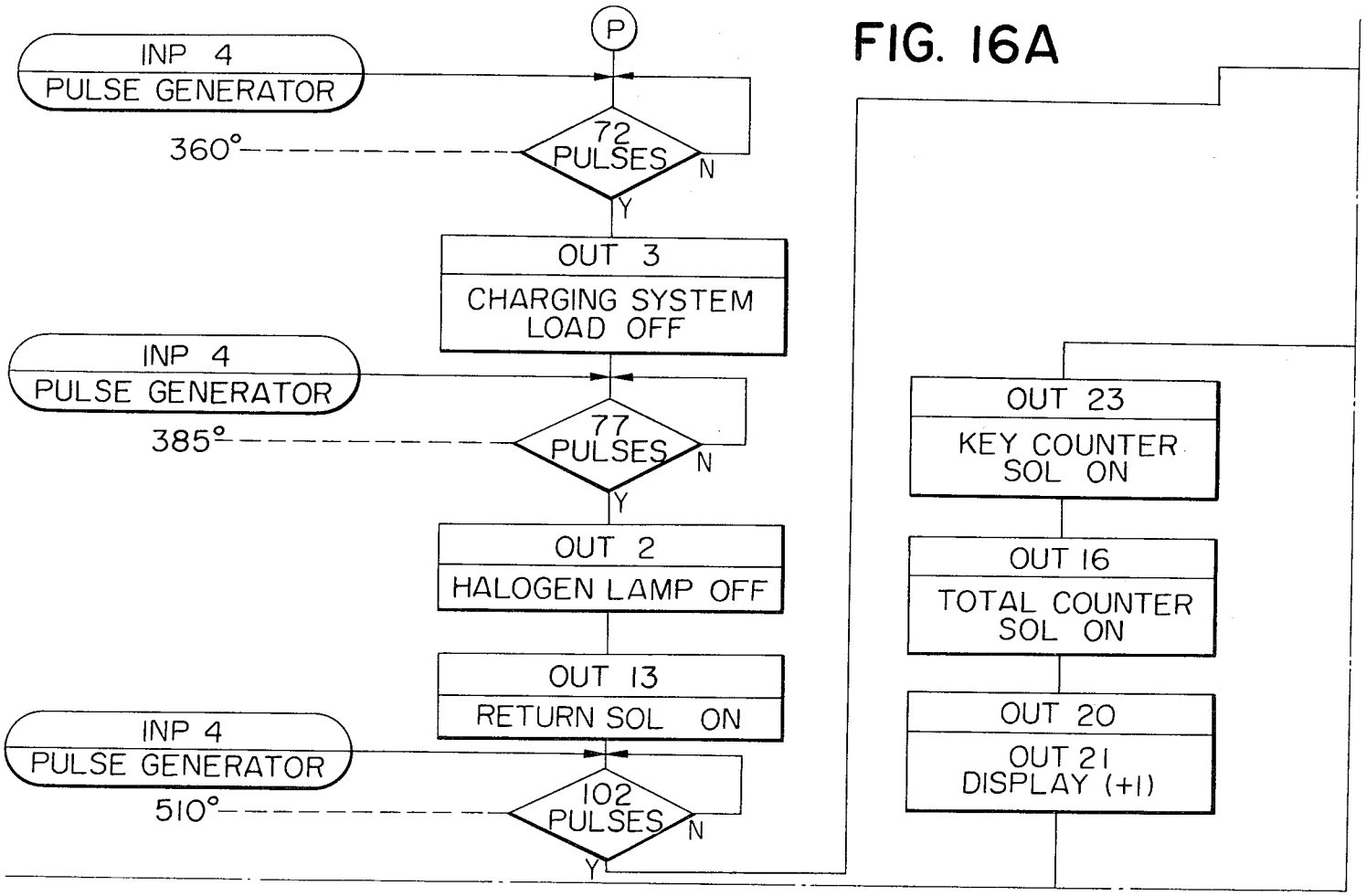
Figure 16B:
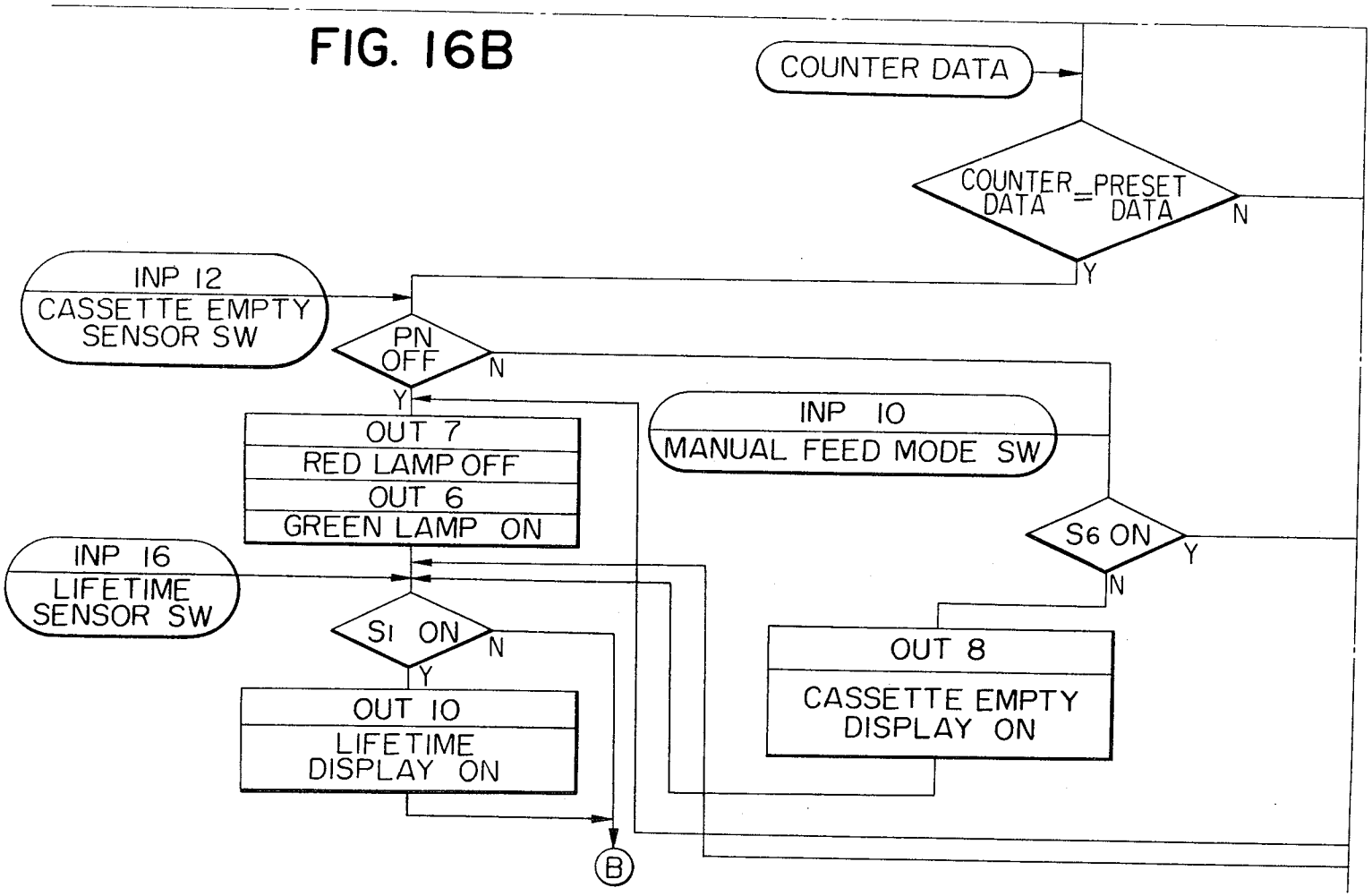
Figure 16D:
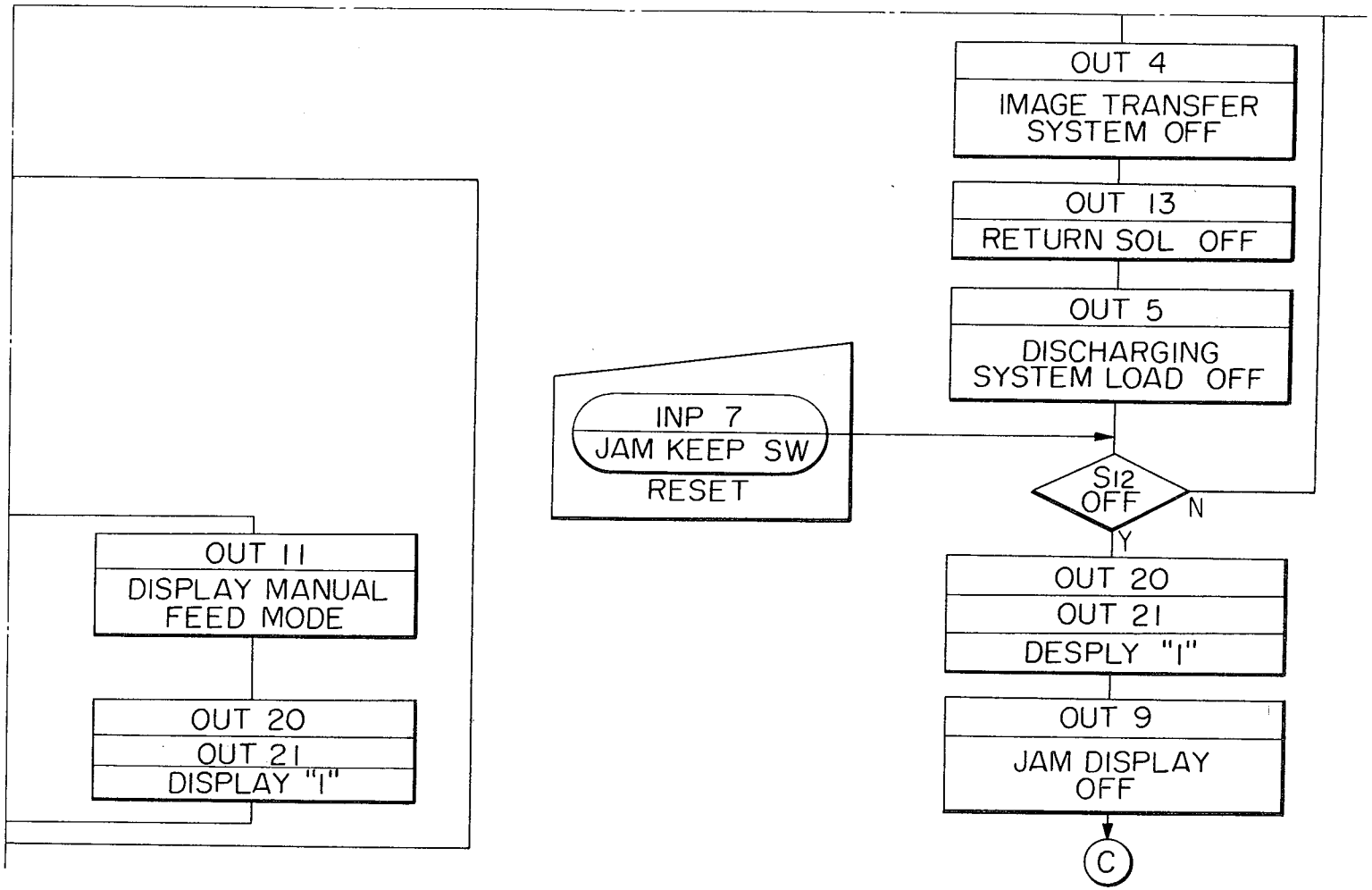

FIG. 16D of the drawings: "DESPLY "1"" should read --DISPLAY "1"--.

Figures 17, 17A:
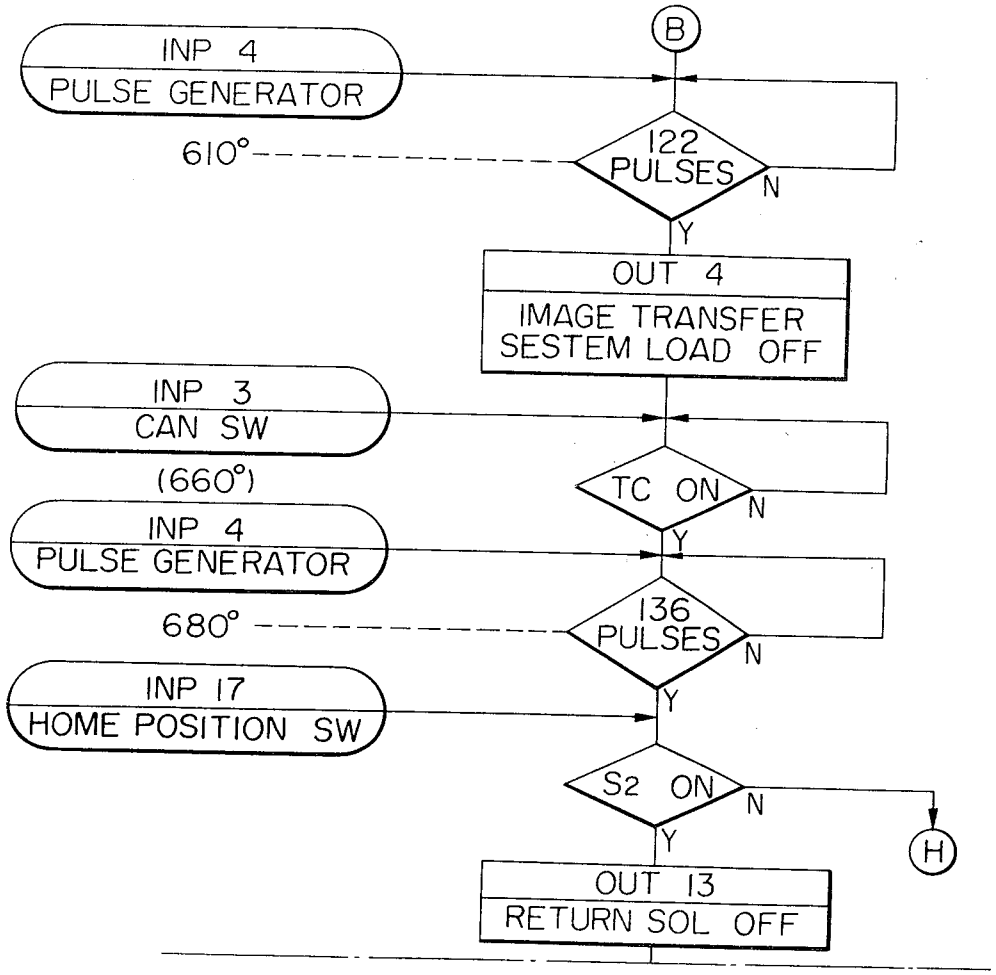
Figure 17B:
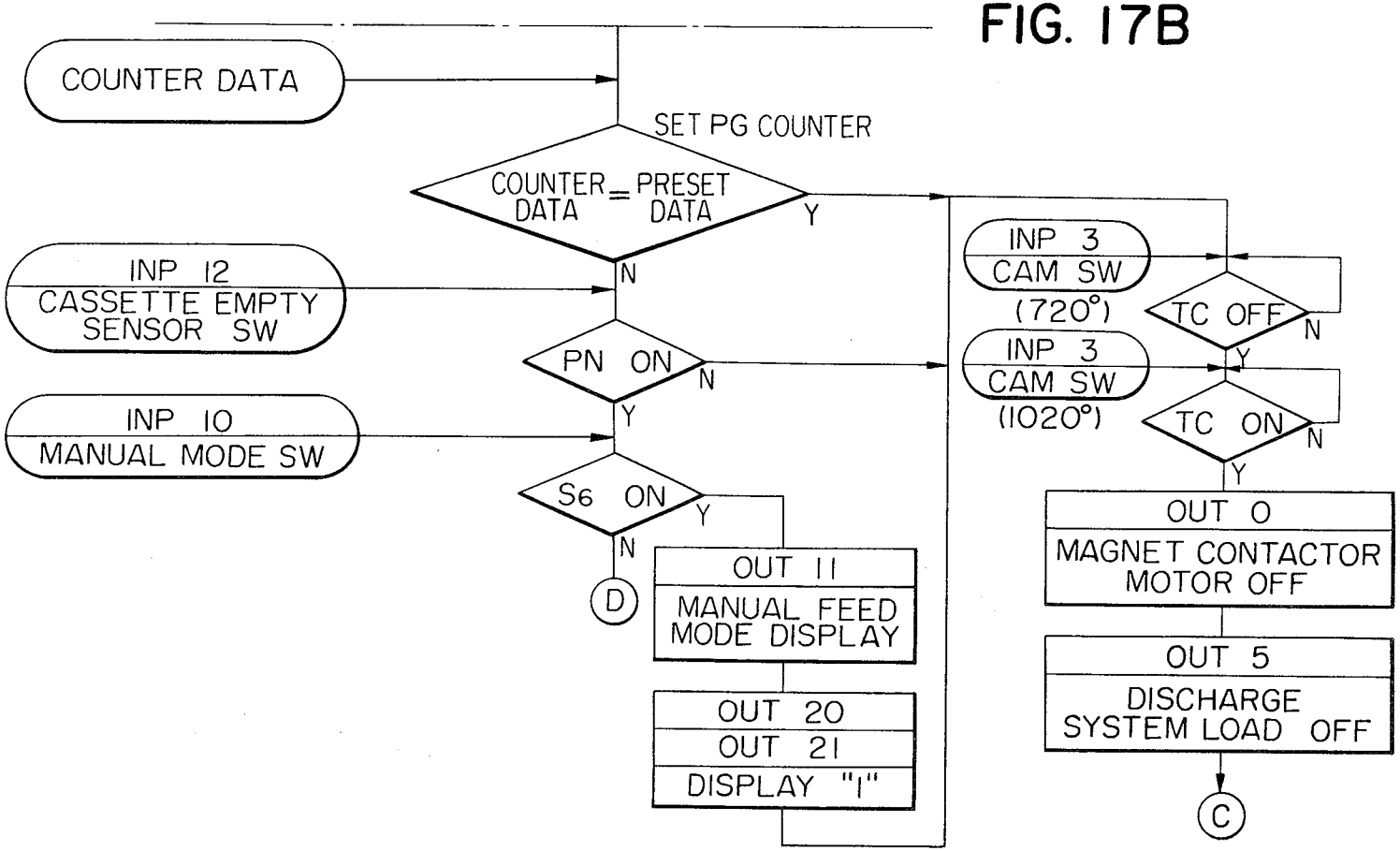

FIG. 17A of the drawings: "SESTEM" should read --SYSTEM--.

Figure 18C:
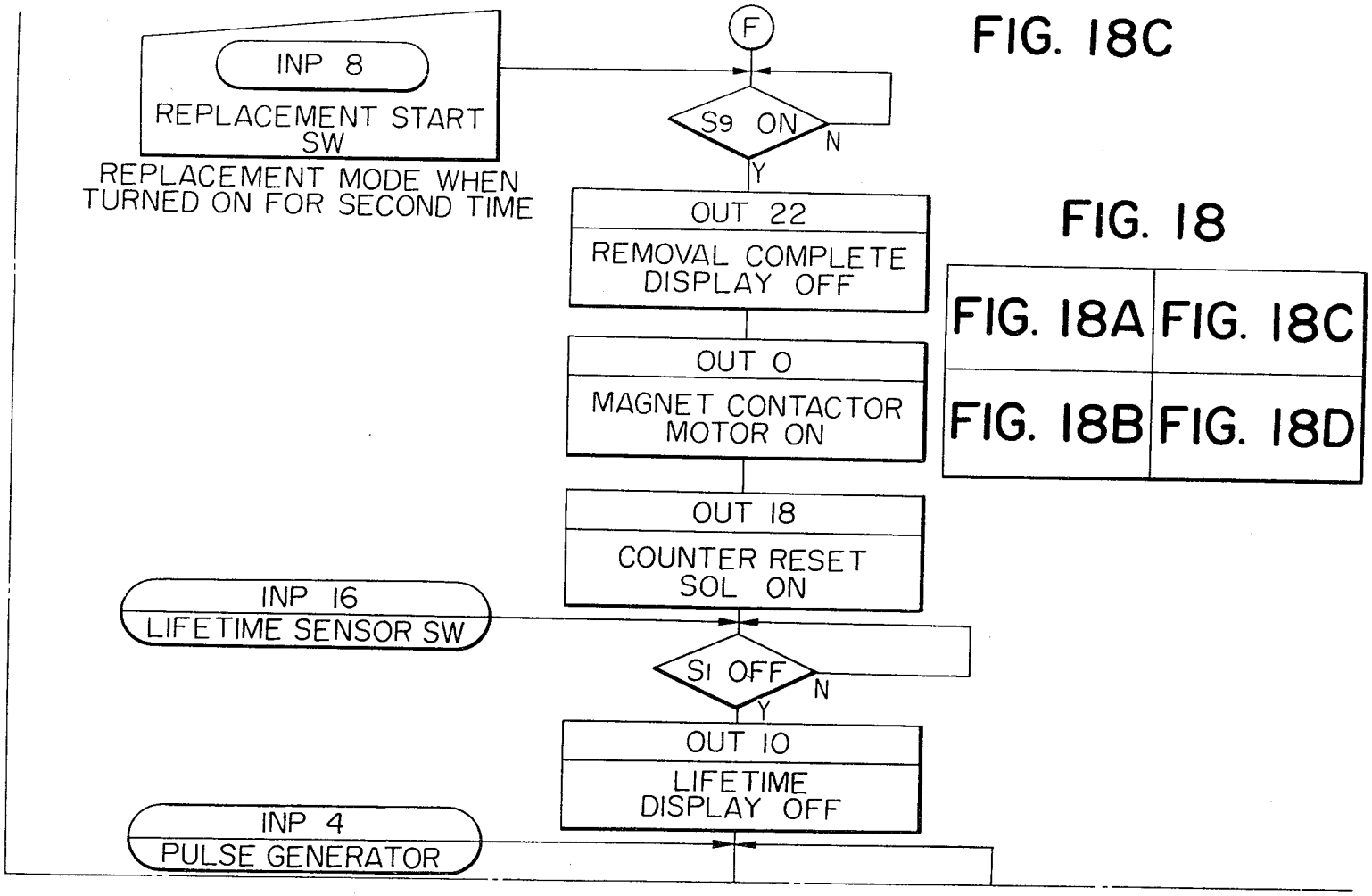
Figure 18A:
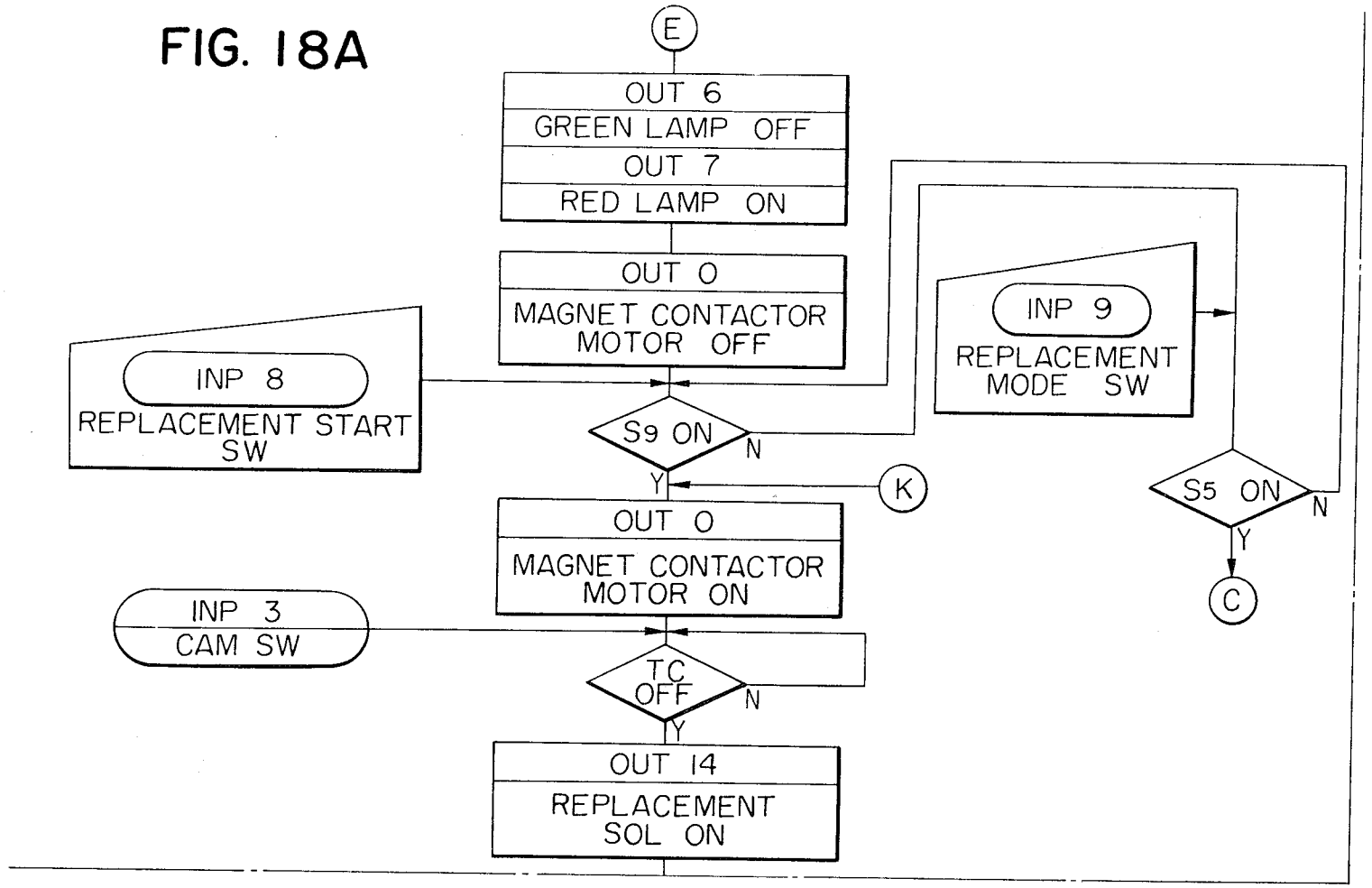
Figure 18B:
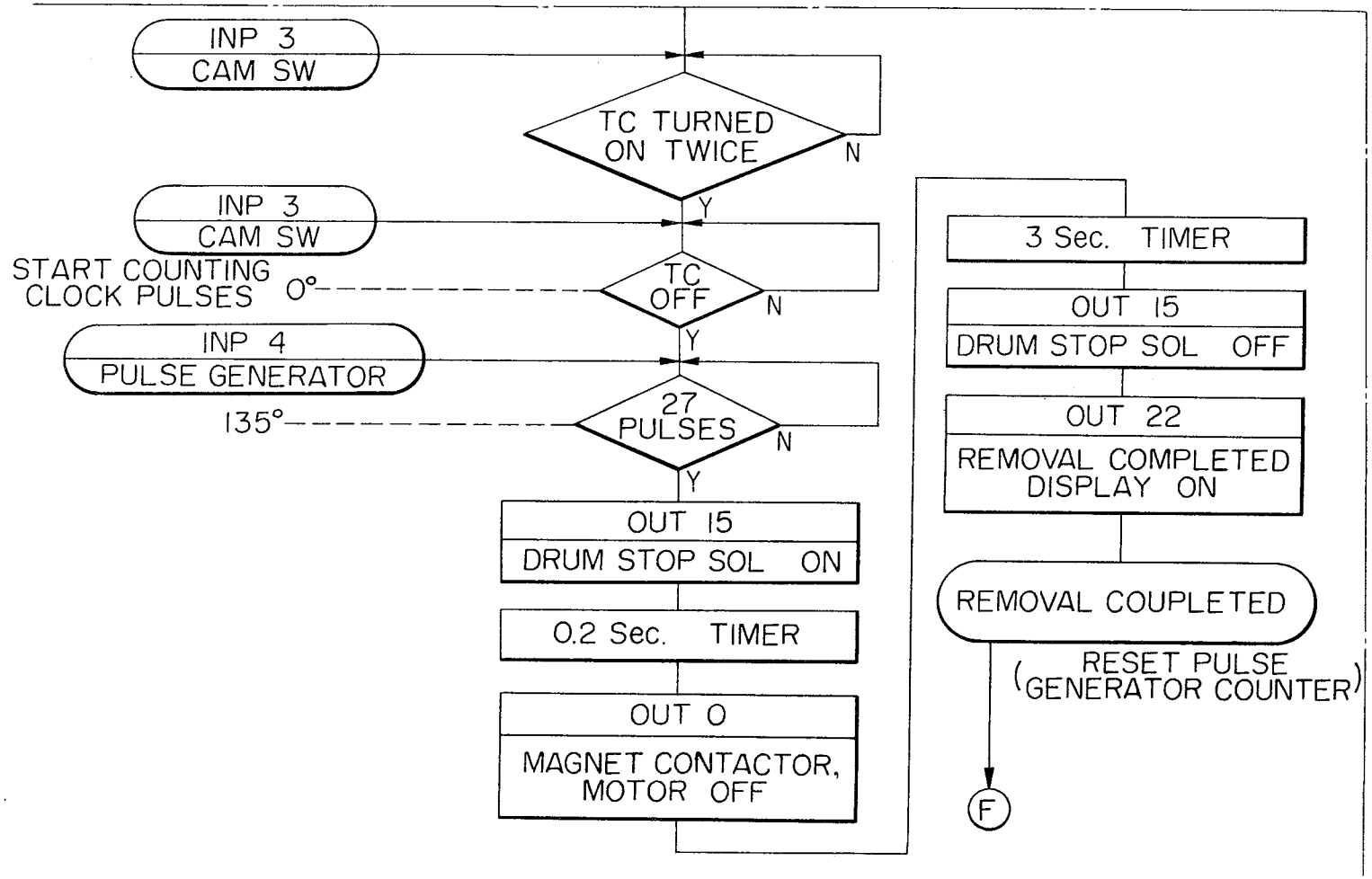
Figure 18D:
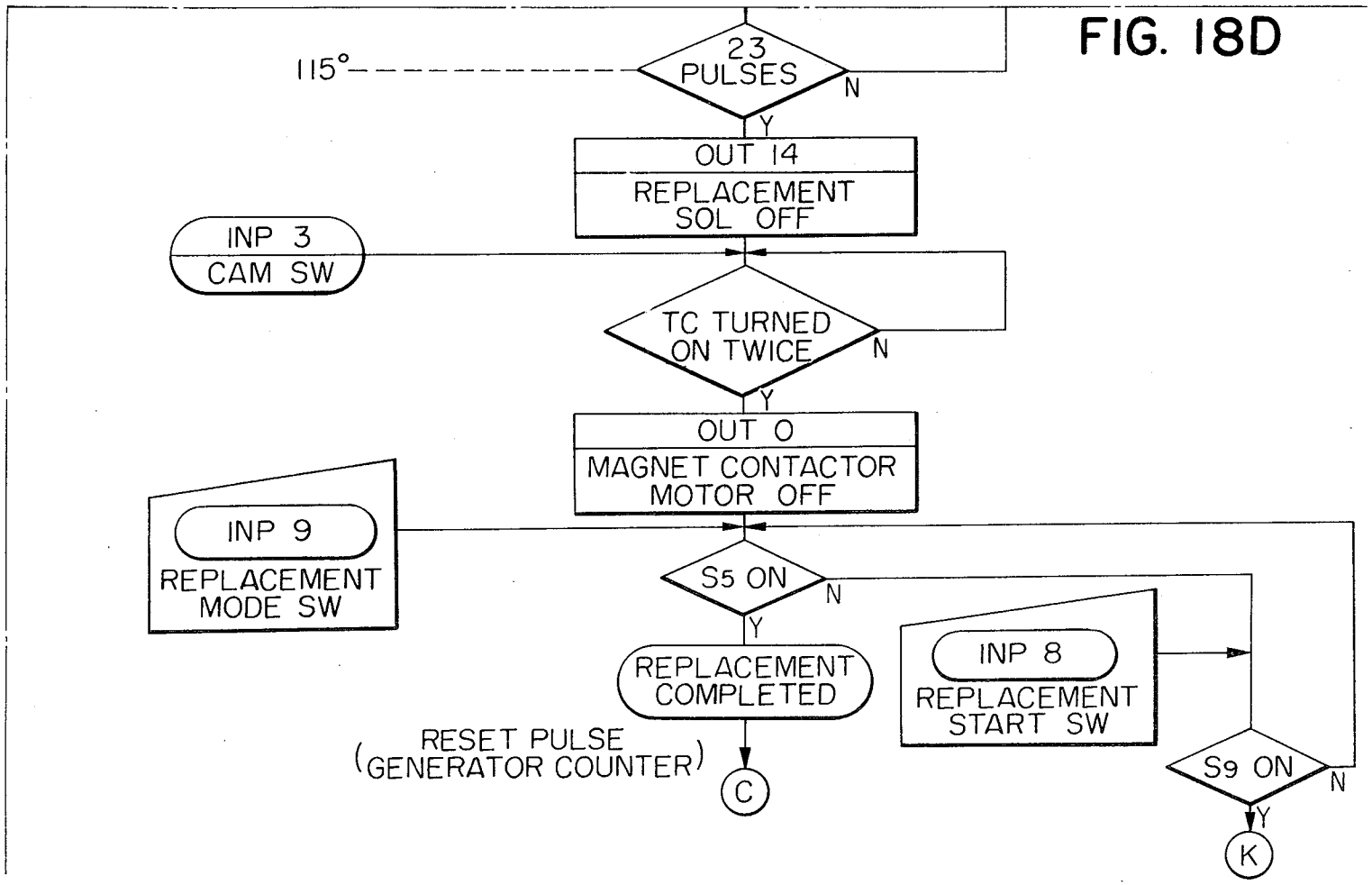

FIG. 18B of the drawings: "COUPLETED" should read --COMPLETED--.

Column 3, line 31: "inclues" should read --includes--.

Signed and Sealed this

*Fifteenth* Day of *June 1982*

[SEAL]

*Attest:*

GERALD J. MOSSINGHOFF

*Attesting Officer* *Commissioner of Patents and Trademarks*